US007491009B1

(12) United States Patent
Remy

(10) Patent No.: US 7,491,009 B1
(45) Date of Patent: Feb. 17, 2009

(54) TRAFFIC INTERSECTION

(75) Inventor: Brian R. Remy, Houston, TX (US)

(73) Assignee: Intersection Solutions LLC, Houston, TX (US)

( * ) Notice: Subject to any disclaimer, the term of this patent is extended or adjusted under 35 U.S.C. 154(b) by 5 days.

(21) Appl. No.: 11/850,311

(22) Filed: Sep. 5, 2007

(51) Int. Cl.
*E01C 1/00* (2006.01)

(52) U.S. Cl. ..... 404/1

(58) Field of Classification Search ..... 404/1
See application file for complete search history.

(56) References Cited

U.S. PATENT DOCUMENTS 4,592,673 A * 6/1986 Lee ..... 404/1
5,049,000 A * 9/1991 Mier et al. ..... 404/1
7,234,891 B2 * 6/2007 Niiya et al. ..... 404/1
2008/0152426 A1 * 6/2008 Liu et al. ..... 404/1

FOREIGN PATENT DOCUMENTS

JP 0525802 A * 2/1993

* cited by examiner

*Primary Examiner*—Raymond W Addie
(74) *Attorney, Agent, or Firm*—Howard L. Speight

(57) ABSTRACT

A traffic intersection is disclosed. One version of the intersection includes a protected turn-around lane that allows traffic to turn around and proceed in the opposite direction. The protected turn-around lane provides for a protected turn without having a traffic indicator phase dedicated to protecting such a turn. Another version of the intersection includes an overpass and a protected path through the overpass allowing traffic to turn around and travel in substantially the opposite direction. Another version of the intersection includes an overpass and a protected turn-around lane.

17 Claims, 22 Drawing Sheets

FIG. 1
(PRIOR ART)
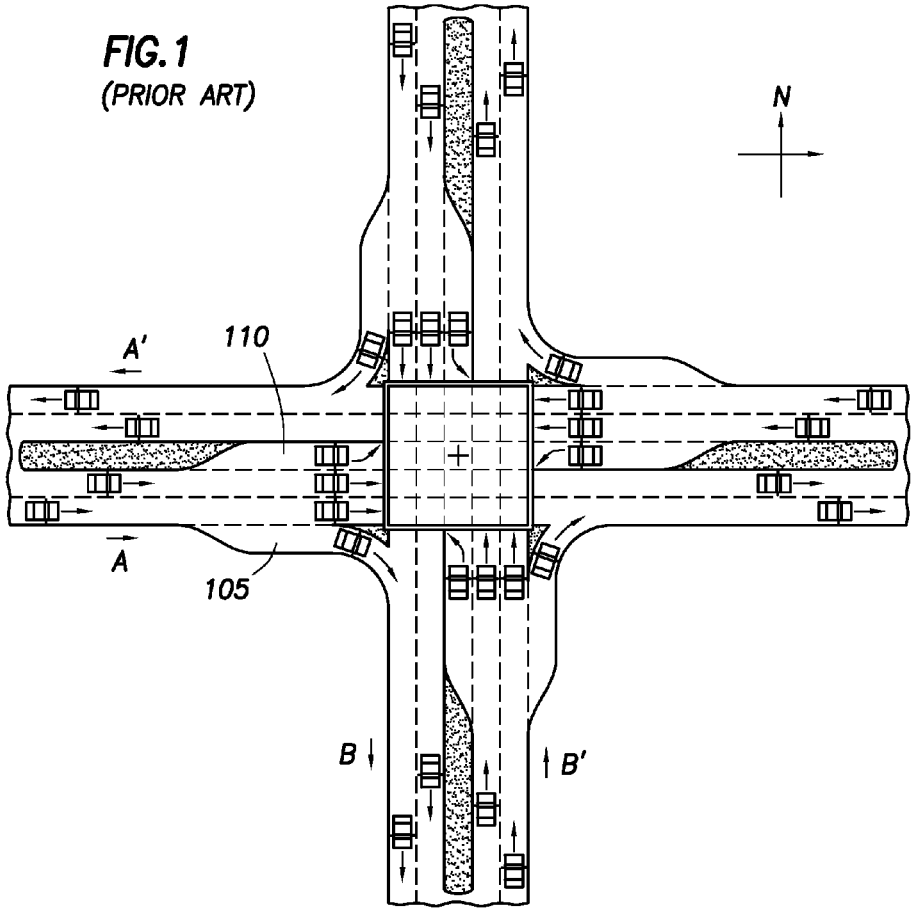
FIG. 1A
(PRIOR ART)
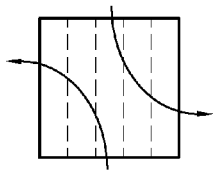
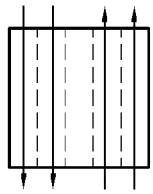
FIG. 1B
(PRIOR ART)
FIG. 1C
(PRIOR ART)
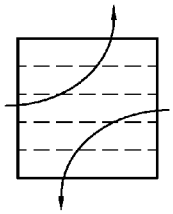
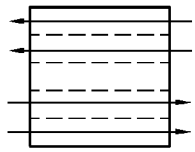
FIG. 1D
(PRIOR ART)

TRAFFIC INTERSECTION

BACKGROUND

One of the most dangerous maneuvers in driving in the United States is making a left turn. In the United States, traffic drives on the right-hand side of the road and on-coming traffic drives on the left-hand side of the road. To make a left turn, a vehicle must cross the on-coming traffic.

In other countries, such as the United Kingdom, traffic drives on the left-hand side of the road and on-coming traffic drives on the right-hand side of the road. In those countries, a right turn is dangerous because it requires crossing on-coming traffic. Throughout the rest of this disclosure we will discuss left turns but a person of ordinary skill would readily recognize that the same concepts and techniques apply to right turns in countries with traffic conventions such as those in the United Kingdom.

A traditional method for reducing the danger of left turns, illustrated in FIG. 1, uses lanes that are dedicated to left turns and traffic lights that include lights that regulate left turns. FIG. 1 shows an intersection between two four-lane roads. An intersection can be two roads crossing at substantially right angles, or it can be one road teeing into another, or it can be two or more roads coming together at an angle, such as in a Y intersection. A road can have any number of lanes and can have any surface.

A road may allow travel in two substantially opposite directions although a road can also be one-way. In FIG. 1, one road has two A lanes for travel in the A direction, i.e., from left to right on the page, and two lanes for travel in the A-prime direction, i.e., from right to left on the page. A second road that intersects with the first road has two B lanes for travel in the B direction, i.e., from top to bottom on the page, and two B-prime lanes for travel in the B-prime direction, i.e., from bottom to top on the page. For simplicity of discussion, it will be assumed for all of the drawings of intersections discussed herein that the top of the page is the north as indicated by the compass included on some or all of the Figure pages. Further, the "arm" of an intersection extending in a particular direction will be referred to in that manner (e.g., the "east arm" referring to the arm of the intersection extending to the right, or east, on the page). However, it will be understood that the orientation of the roads with respect to the compass is not limiting. For example, FIG. 1 may be oriented such that north on the compass is at the top of the drawing or it may be to the right of the drawing or any other orientation.

In the traditional approach illustrated in FIG. 1, each set of lanes is provided with a right-turn lane. For example, a vehicle would use right-turn lane 105 to turn from the A lanes to the B lanes. Similarly, each set of lanes is provided with a left-turn lane. For example, a vehicle would use left-turn lane 110 to turn from the A lanes to the B-prime lanes.

In addition, in the traditional approach illustrated in FIG. 1 the intersection may be controlled by traffic indicators, such as traffic lights. A different set of traffic lights may be devoted to some or all of the directions that traffic can travel through the intersection. Each direction may have the traditional red (for stop), yellow (for caution), and green (for proceed) lights, each color representing a state of the traffic flow. A turn may have a green arrow, indicating that the turn can be made, instead of the traditional green light. Similarly, the yellow and red lights for a turn can be replaced with yellow and red arrows, respectively. As an alternative to lights, the states may be represented by mechanical indicators, such as wooden, metal, or cloth flags. The traffic indicators may be attached to a pole adjacent the road or they may be suspended from a cable strung across the intersection.

The traffic indicators may have phases. A traffic indicator "phase" defines the state of the traffic indicators at an intersection. For example, one phase may be defined by the left turn indicator for the turn from the A lanes to the B-prime lanes being green and all other lights being red. Another phase may be for the lights over the A lanes and the A-prime lanes to be green and all other lights to be red. Each phase may define a set of one or more protected paths through an intersection. A "protected path" is one in which traffic has right of way superior to that of traffic following intersecting paths. For example, an intersection between two bi-directional roads may have four phases, such as those illustrated in FIGS. 1A-D. In the first and third phases (FIGS. 1A and 1C), left turns are protected paths and through traffic is not allowed. In the second and fourth phases (FIGS. 1B and 1D), through traffic lanes are protected paths and left turns are not protected paths (and may not be allowed). A "cycle" is a progression through the phases of the one or more traffic indicators. In some cases of "running through a cycle," a phase may be skipped. For example, in the intersection illustrated in FIG. 1, a detector may be situated to detect whether traffic is waiting to turn left. If there is no such traffic one or more of the left-turn phases may be skipped.

SUMMARY

In general, in one aspect, the invention features an article of manufacture for use in an intersection between two roads. The intersection has one or more traffic indicators to control the flow of traffic through the intersection. The one or more traffic indicators collectively have one or more traffic indicator phases. Each traffic indicator phase specifies the traffic allowed to flow through the intersection during that traffic indicator phase. The intersection includes one or more A lanes for traffic proceeding in direction A, one or more A-prime lanes for traffic proceeding in direction A-prime, substantially opposite direction A, one or more B lanes for traffic proceeding in direction B intersecting the A lanes and the A-prime lanes, and one or more B-prime lanes for traffic proceeding in direction B-prime, substantially opposite direction B. The intersection also includes a protected turn-around lane situated between the B lanes and the B-prime lanes. The protected turn-around lane is reached by turning from the A lanes to the B lanes. The protected turn-around lane allows traffic proceeding in direction B to turn around and proceed in direction B-prime. The protected turn-around lane provides for a protected turn from the A lanes to the B-prime lanes without having a traffic indicator phase dedicated to protecting such a turn.

Implementations of the invention may include one or more of the following. The protected turn-around lane may have a generally elliptical shape. The generally elliptical shape may have one or more radii of curvature. The radii of curvature may be sufficient to allow a vehicle of a predetermined size to turn through the protected turn-around lane. The intersection may include a do-not-block area in the B-prime lanes adjacent the protected turn-around lane, where through traffic is not to stop. The intersection may include a merge lane allowing traffic to merge from one of the B-prime lanes into the protected turn-around lane. The intersection may include using a second protected turn-around lane opposite the protected turn-around lane as an extended merge lane for merging into the B-prime lanes.

In general, in another aspect, the invention features an article of manufacture for use in an intersection between two roads. The intersection includes one or more A lanes for traffic proceeding in direction A, one or more A-prime lanes for traffic proceeding in direction A-prime, substantially opposite direction A, one or more B lanes for traffic proceeding in direction B intersecting the A lanes and the A-prime lanes, and one or more B-prime lanes for traffic proceeding in direction B-prime, substantially opposite direction B. The intersection includes an overpass to allow the B lanes and the B-prime lanes to pass over the A lanes and the A-prime lanes. The intersection includes an A exit lane from the A lanes, allowing traffic exiting the A lanes to travel in direction B. The intersection includes a path through the overpass allowing traffic moving in direction B to turn around and travel in direction B-prime. The path is a protected path. The A exit lane connects to an entrance side of the path. A B-prime entrance lane connects to an exit side of the path. The B-prime entrance lane allows traffic to enter the B-prime lanes.

Implementations of the invention may include one or more of the following. The intersection may include B access lanes parallel and adjacent to the B lanes. The A exit lane connection to the entrance side of the path may be under the B access lanes. A B entrance lane may be connected to the A exit lane. The B entrance lane may allow traffic to enter the B lanes. The path may be a tunnel. The intersection may include a B exit lane from the B lanes. The B exit lane may connect to an entrance side of the path. An A entrance lane connecting to an exit side of the path. The A entrance lane may allow traffic to enter the A lanes. The intersection may include an A-prime exit lane from the A-prime lanes, allowing traffic exiting the A-prime lanes to travel in direction B-prime. The intersection may include a second path through the overpass allowing traffic moving in direction B-prime to turn around and travel in direction B, the path being a protected path. The A-prime exit lane may connect to an entrance side of the second path. The intersection may include a B entrance lane connecting to an exit side of the second path. The B entrance lane may allow traffic to enter the B lanes. The intersection may include a B-prime exit lane from the B-prime lanes. The B-prime exit lane may connect to an entrance side of the second path. The intersection may include an A-prime entrance lane connecting to an exit side of the second path. The A-prime entrance lane may allow traffic to enter the A-prime lanes. The intersection may include B-prime access lanes parallel and adjacent to the B-prime lanes. The A-prime exit lane connection to the entrance side of the second path may be under the B-prime access lanes. The intersection may include a B-prime entrance lane connected to the A-prime exit lane. The B-prime entrance lane allows traffic to enter the B-prime lanes.

In general, in another aspect, the invention features an article of manufacture for use in an intersection between two roads. The intersection includes one or more A lanes for traffic proceeding in direction A, one or more A-prime lanes for traffic proceeding in direction A-prime, substantially opposite direction A, one or more B lanes for traffic proceeding in direction B intersecting the A lanes and the A-prime lanes, and one or more B-prime lanes for traffic proceeding in direction B-prime, substantially opposite direction B. The intersection also includes an overpass to allow the B lanes and the B-prime lanes to pass over the A lanes and the A-prime lanes. The intersection includes a protected turn-around lane situated between the B lanes and the B-prime lanes. The protected turn-around lane is reached by turning from the A lanes to the B lanes crossing under one or more B lanes through the underpass. The protected turn-around lane allows traffic proceeding in direction B to turn around and proceed in direction B-prime.

Implementations of the invention include one or more of the following. The intersection may include an A exit lane from the A lanes, allowing traffic exiting the A lanes to travel in direction B. The intersection may include a protected turn-around lane situated between the A lanes and the A-prime lanes. The protected turn-around lane may be reached by turning from the B-prime lanes to the A lanes crossing over one or more A lanes as part of the overpass. The protected turn-around lane allows traffic proceeding in direction A to turn around and proceed in direction A-prime. The intersection may include a B-prime exit lane from the B-prime lanes, allowing traffic exiting the B-prime lanes to travel in direction A.

BRIEF DESCRIPTION OF THE DRAWINGS

FIG. 1 is a top view of a prior art intersection.

FIGS. 1A-1D illustrate phases associated with the prior art intersection shown in FIG. 1.

DETAILED DESCRIPTION

An improved intersection reduces the number of traffic indicator phases and in some cases eliminates traffic indicator phases entirely. This has two positive effects. First, reducing the number of phases may improve the amount of time required for a vehicle to clear an intersection. This is because a vehicle may be required to wait through the intersection's other phases before crossing the intersection in the phase in which traffic is allowed flowing in the direction the vehicle desires to travel. Second, because reducing the number of phases reduces the number of phase transitions in each cycle, the number of red light accidents will be reduced.

Figure 2:
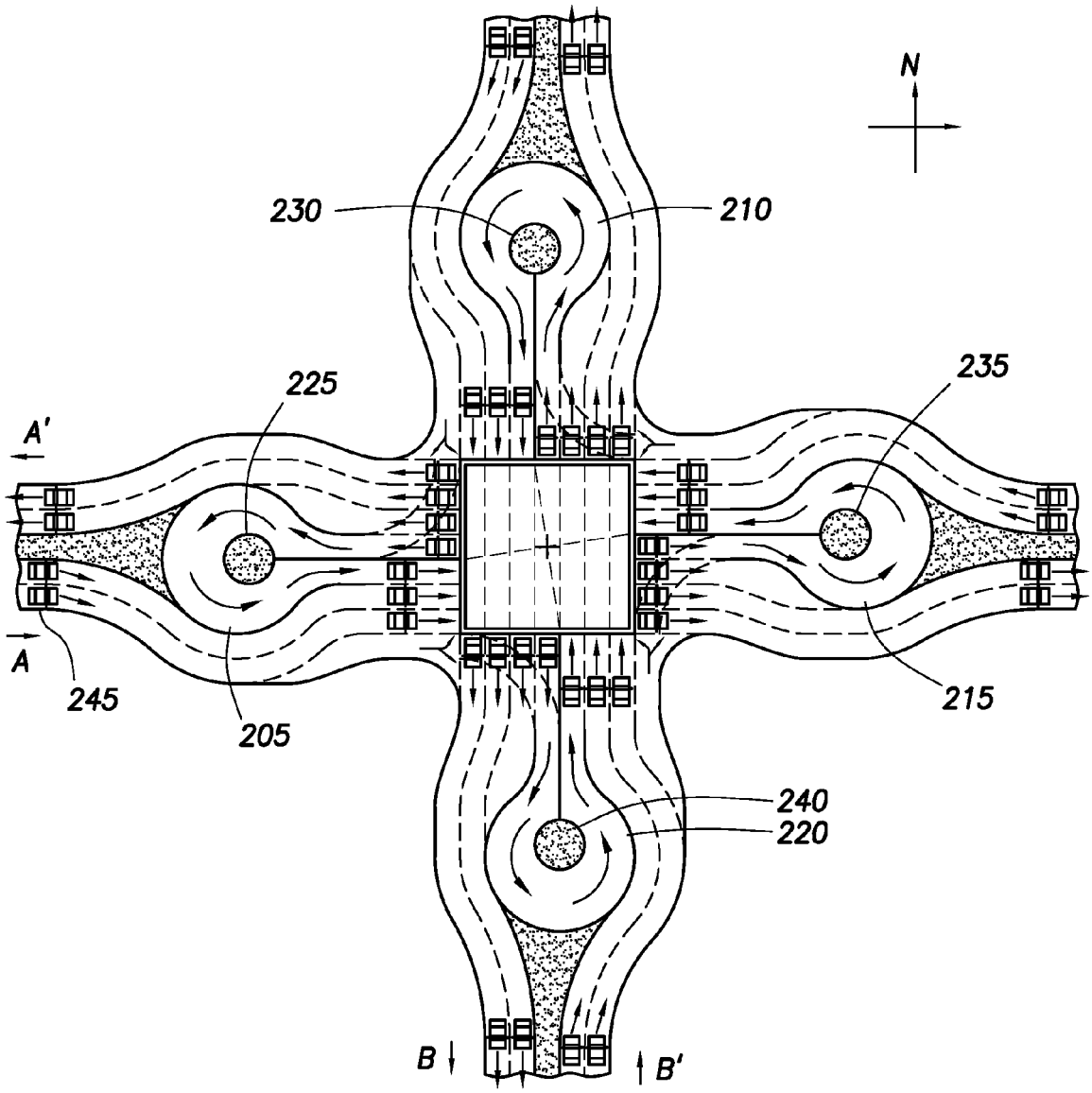
FIG. 2 is a top view of one embodiment of an intersection.

One embodiment of an improved intersection, illustrated in FIG. 2, includes protected turn-around lanes 205, 210, 215, 220. The "protected turn-around lanes" can be as shown in FIG. 2. That is, it can be defined by a concrete structure, e.g. 225, between the lanes traveling in one direction (e.g., the A direction) and the lanes traveling in substantially opposite direction (e.g., the A-prime direction). Alternatively, the "protected turn-around lane" can be defined with paint. For example, the concrete structure 225 in FIG. 2 could be replaced by painted stripes or any other device to guide traffic. FIG. 2 shows protected turn-around lanes 205, 210, 215, 220 in each arm of the intersection. It will be understood by the person or ordinary skill that an improved intersection could also be made with fewer than all of the concrete structures and protected turn-around lanes.

The intersection illustrated in FIG. 2 provides a protected left turn from any direction without dedicating a traffic indicator phase to that left turn. A "protected turn" is a protected path that involves a turn. So, in the example shown in FIG. 2, a vehicle traveling in direction A arriving at the intersection and wishing to turn left into direction B-prime can turn right onto the B lanes (a) when the indicator for lanes proceeding in direction A is red, in which case the turn is not a protected path and a merge is required, or (b) when the indicator for lanes proceeding in direction A is green, in which case the turn is a protected path and no merge is required. Thus, the turn can be made without being forced to merge.

In either case, once the vehicle turns from the A lanes to the B lanes it can move into the protected turn-around lane 220, which allows the vehicle to turn around from the B direction to the B-prime direction. Once this maneuver is complete, the vehicle has made the desired left turn from the A direction to the B-prime direction. Upon completing the turn, the vehicle must wait at the intersection until the traffic indicators provide that passing through the intersection in the B-prime direction is permissible. Left turns from the other lanes (i.e., from the A-prime lanes to the B lanes, from the B lanes to the A lanes, and from the B-prime lanes to the A-prime lanes) is accomplished in a similar fashion.

The intersection shown in FIG. 2 requires more area than the intersection shown in FIG. 1. In particular, the road is approximately 10 lanes wide in the vicinity of the concrete structures 225, 230, 235, and 240 in FIG. 2 compared to approximately 5 lanes wide without the concrete structures in FIG. 1. The improvement in safety and efficiency compensates for the additional land requirements.

Figure 3:
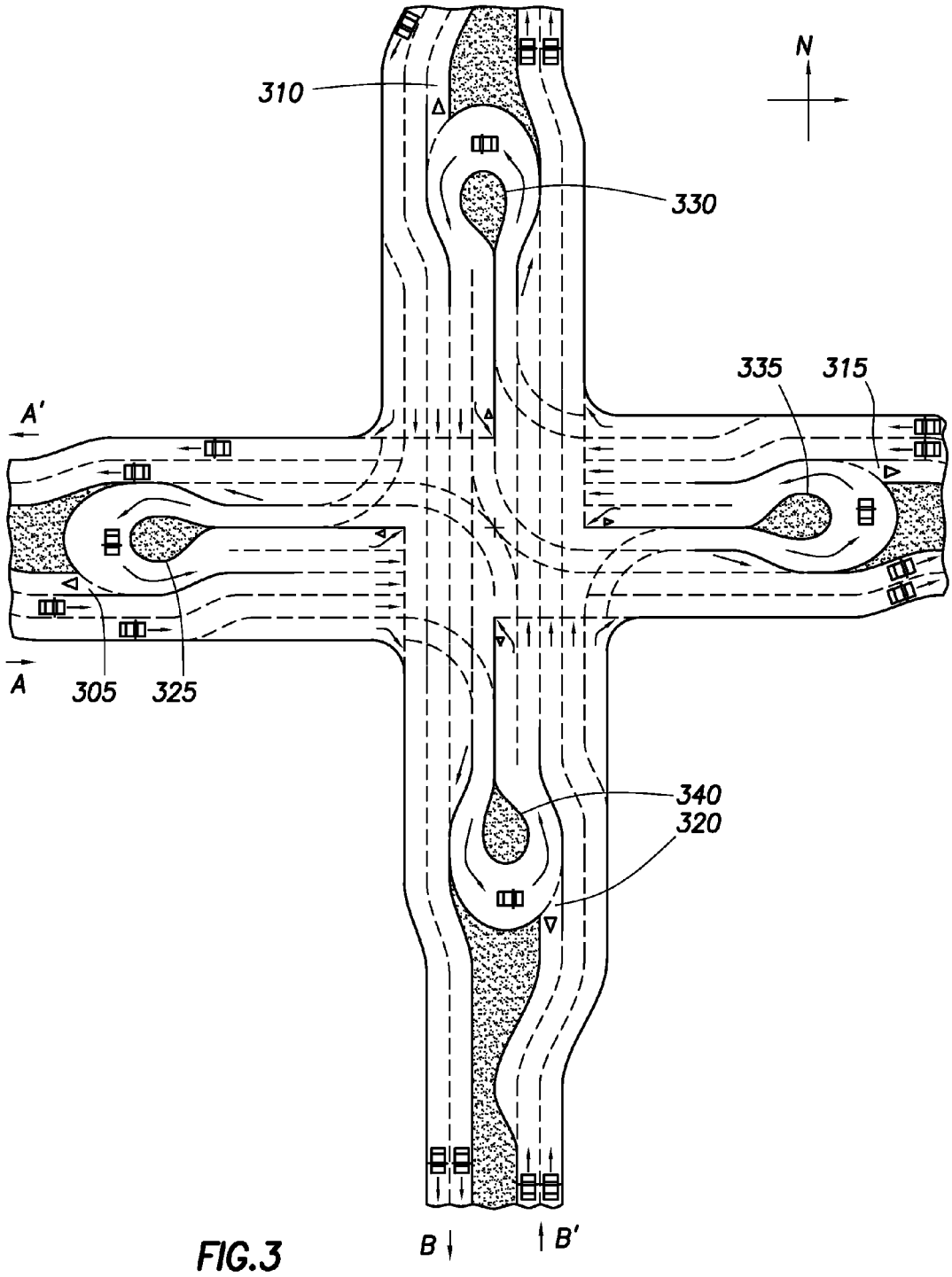
FIG. 3 is a top view of one embodiment of an intersection.

A merge lane 305, 310, 315, 320, as shown in FIG. 3, may be added to allow large vehicles, such as fire trucks or busses that might require a greater turning radius than that allowed by the protected turn-around lanes 205, 210, 215, 220 shown in FIG. 2. For example a large vehicle wishing to make a left turn from the A lanes to the B-prime lanes might enter the merge lane 305 and enter the protected turn-around lane 205 and then make a traditional unprotected left turn (assuming the intersection does not include a left turn arrow making the turn a protected one). Alternatively, the protected turn-around lanes 205, 210, 215, 220 may be designed to have a turning radius to handle any sized vehicle.

The concrete structures 325, 330, 335, 340 have a teardrop shape in FIG. 3 as compared to the round shape of the concrete structures 225, 230, 235, and 240 in FIG. 2. The concrete structures can have any suitable shape. They can be asymmetrical, as shown in FIGS. 4C and 4D.

Figure 4:
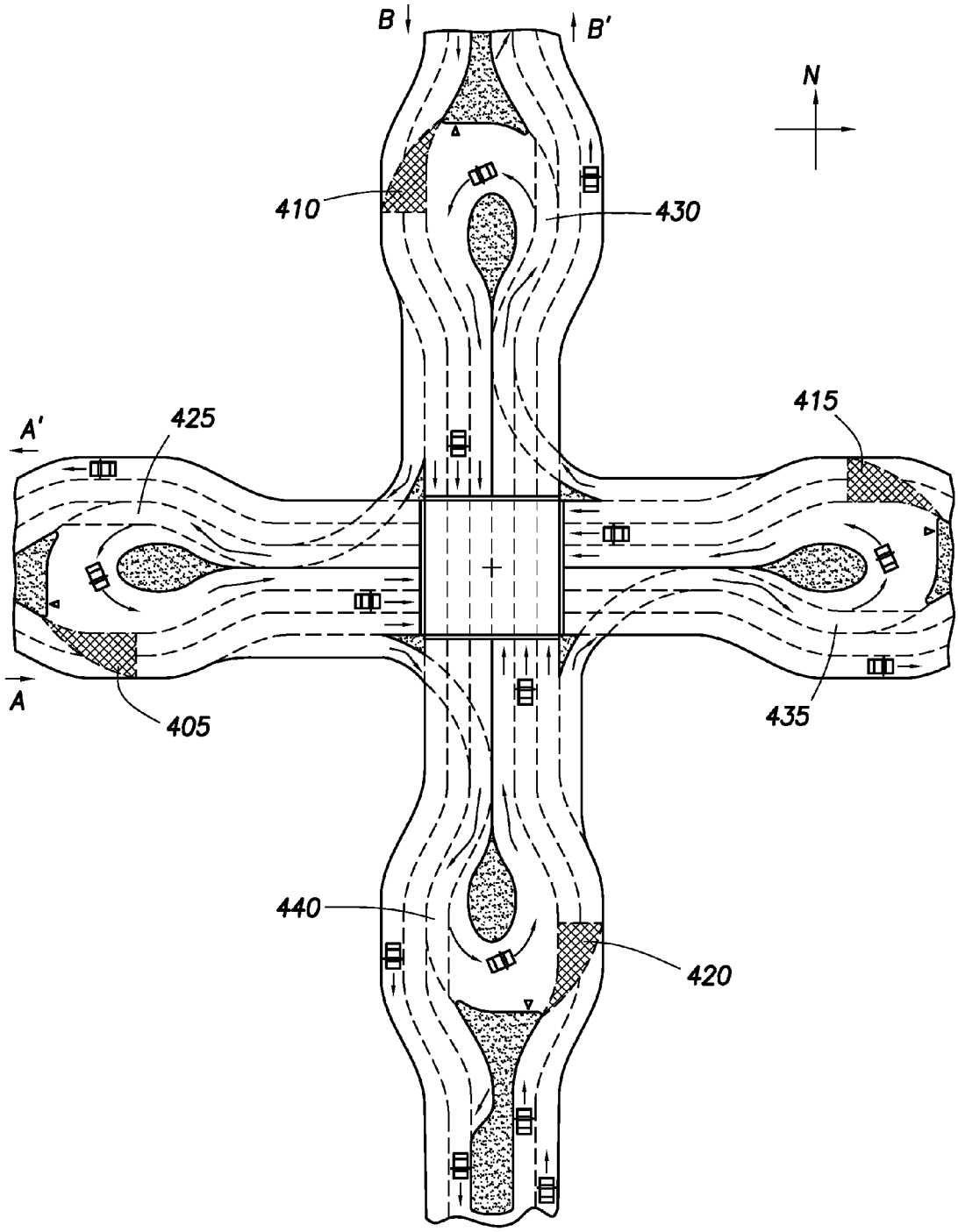
FIG. 4 is a top view of one embodiment of an intersection.

Do-not-block areas 405, 410, 415, 420, as shown in FIG. 4 (they are also shown in FIGS. 5-8 and 10-11), which may be demarked with cross-hatched paint, such as is shown in FIG. 4, or any other suitable means, define turning regions where vehicles traveling in the through lanes are not allowed to stop. They allow greater clearance for vehicles turning in the protected turn-around lanes.

Figures 5, 5A, 5B, 5C:
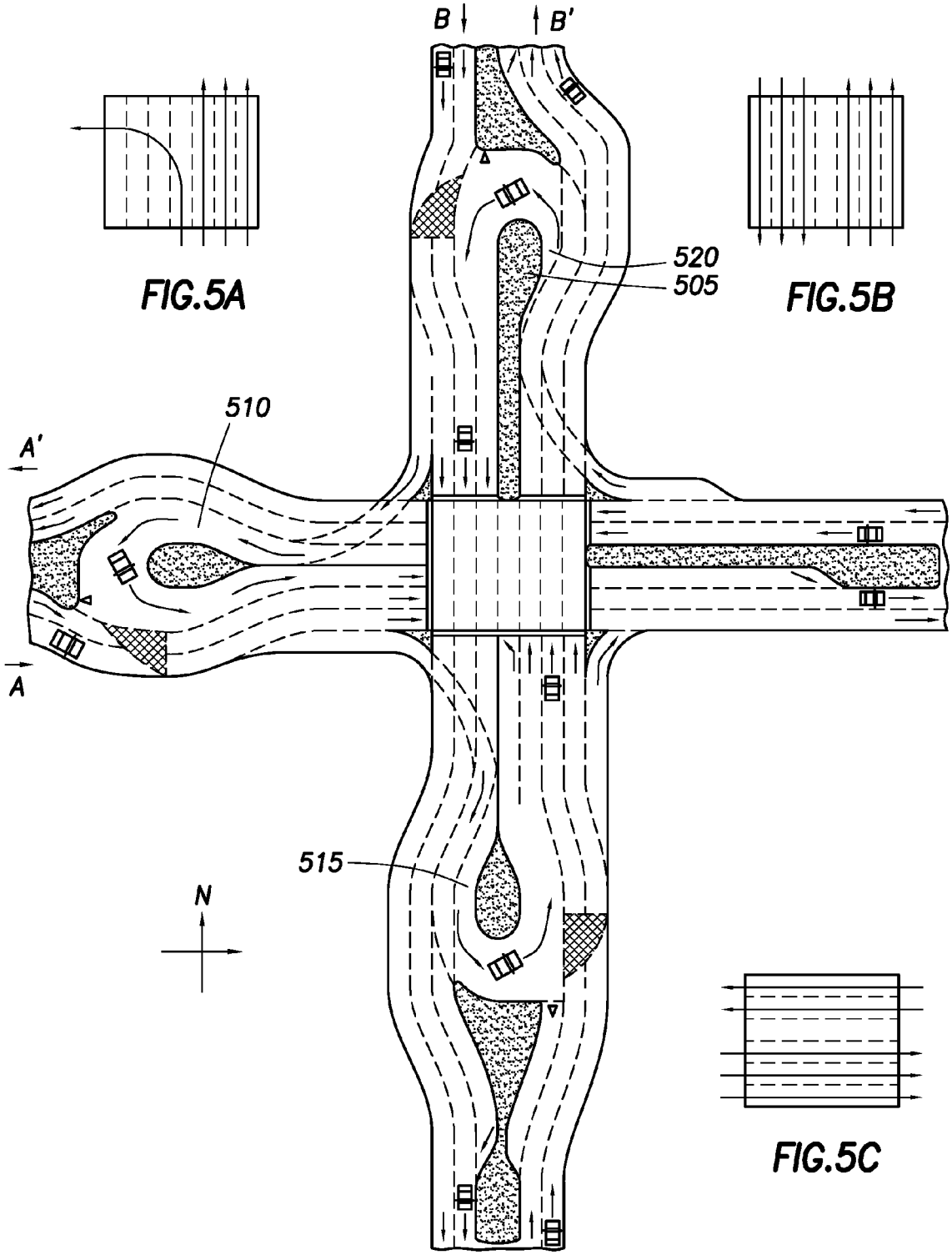
FIG. 5 is a top view of one embodiment of an intersection.
FIGS. 5A-5C illustrate the phases associated with the intersection embodiment shown in FIG. 5.
Figures 6, 6A, 6B, 6C:
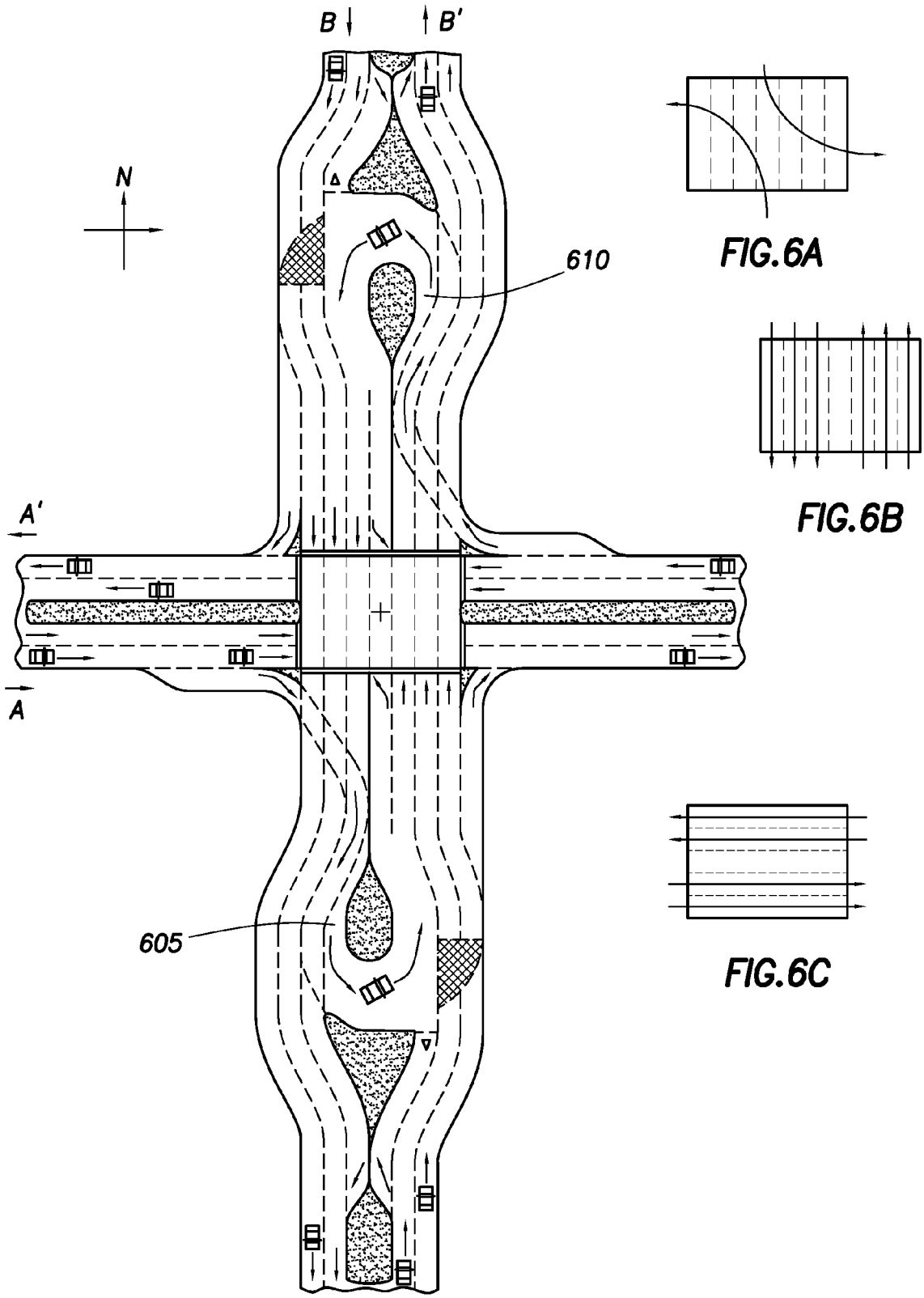
FIG. 6 is a top view of one embodiment of an intersection.
FIGS. 6A-6C illustrate the phases associated with the intersection embodiment shown in FIG. 6.

Extended merge lanes 425, 430, 435, 440, as shown in FIG. 4 (they are also shown in FIGS. 5 and 6), provide a path through the turn-around lanes that doubles as an extended merge area. This allows the length of the merge lane to no longer be limited by the placement of the turn-around lane.

Figure 4A:
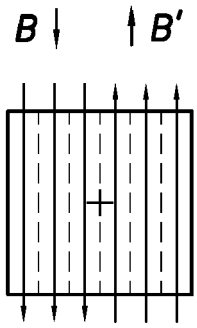
FIGS. 4A-4B illustrate the phases associated with the intersection embodiment shown in FIG. 4.
Figure 4B:
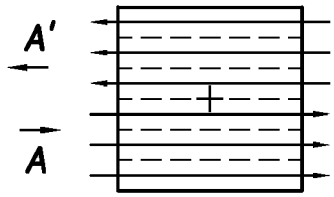
Figure 4C:
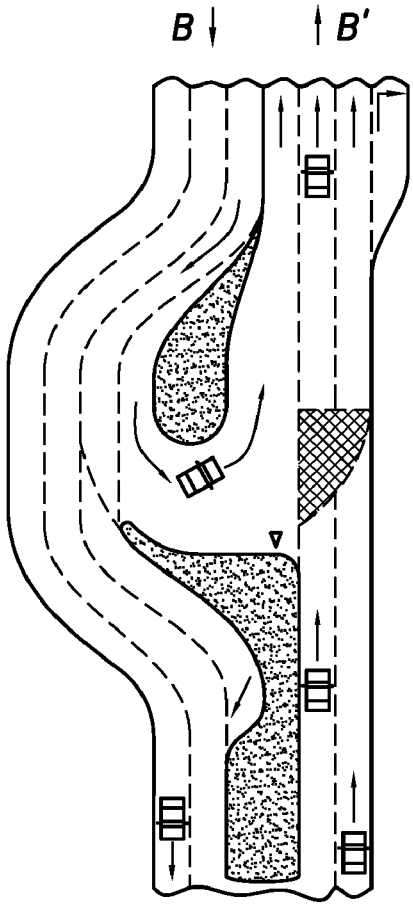
FIGS. 4C-4D illustrate variations of the intersection embodiment shown in FIG. 4.
Figure 4D:
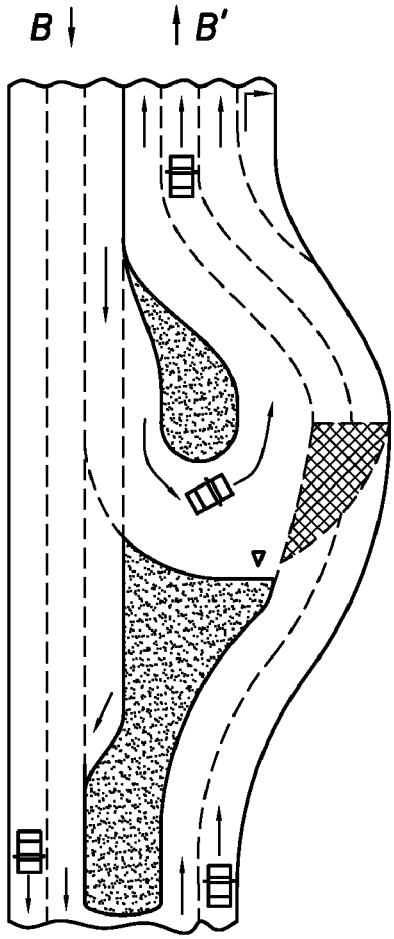

The intersections shown in FIGS. 2, 3, and 4 have two traffic phases, as shown in FIGS. 4A and 4B. In one phase (FIG. 4A), traffic flows in the B direction and the B-prime direction. Also, traffic that had turned from the A lanes into the protected turn-around lane 220 can complete a left turn into the B-prime lanes and traffic that had turned from the A-prime lanes into the protected turn-around lane 210 can complete a left turn into the B lanes. In the other phase (FIG. 4B), traffic flows in the A direction and the A-prime direction. Also, traffic that had turned from the B lanes into the protected turn-around lane 205 can complete a left turn into the A lanes and traffic that had turned from the B-prime lanes into the protected turn-around lane 215 can complete a left turn into the A-prime lanes.

Thus, the intersection shown in FIGS. 2, 3, and 4 provides the same left-turn functionality as the intersection shown in FIG. 1, with fewer traffic phases. This improves the efficiency of the intersection.

Other configurations of intersections are also possible. For example, as shown in FIG. 5, it may be that not all arms of the intersection are provided with protected turn-around lanes. In FIG. 5, protected turn-around lanes are provided for traffic turning from the A lanes to the B-prime lanes, from the B lanes to the A lanes, and from the A-prime lanes to the B lanes, but not from the B-prime lanes to the A-prime lanes.

The intersection shown in FIG. 5 has three phases. In the first, shown in FIG. 5A, traffic proceeds in the B-prime direction and turns left from the B-prime lanes to the A-prime lanes. In the second phase, illustrated in FIG. 5B, traffic proceeds in the B direction and in the B-prime direction. The second phase also allows protected left turns from the A-prime lanes to the B lanes using the protected turn-around lane 520 in the north arm of the intersection and protected left turns from the A lanes to the B-prime lanes using the protected turn-around lane 515 in the south arm of the intersection. In the third phase, illustrated in FIG. 5C, traffic proceeds in the A direction and in the A-prime direction. The third phase also allows protected left turns from the B lanes to the A-prime lanes using the protected turn-around lane 510 in the west arm of the. The first phase could be eliminated by providing a protected turn-around lane from the B-prime lanes to the A-prime lanes. It may be necessary to have an intersection configured as shown in FIG. 5 if, for example, it is not possible to acquire land to accommodate the wider footprint needed by the protected turn-around lane.

FIG. 5 also illustrates another configuration of the concrete structure 505. Concrete structure 505 has more of the shape of a traditional median strip and extends from the turn-around lane to the A lanes.

FIG. 6 illustrates another possible intersection configuration, in which two opposite arms of the intersection have protected turn-around lanes but the other two do not. In the example shown in FIG. 6, protected turn-around lanes are provided for turns from the A-prime lanes to the B lanes and from the A lanes to the B-prime lanes but not from the B-prime lanes to the A-prime lanes or from the B lanes to the A lanes.

The intersection shown in FIG. 6 has three phases. The first, shown in FIG. 6A, allows turns from the B-prime lanes to the A-prime lanes and from the B lanes to the A lanes. The second phase, shown in FIG. 6B, allows traffic to proceed in the B lanes and the B-prime lanes. The second phase also allows protected left turns from the A lanes to the B-prime lanes using the protected turn-around lane 605 in the south arm of the intersection and protected left turns from the A-prime lanes to the B lanes using protected turn-around lane 610 in the north arm of the intersection. The third phase, shown in FIG. 6C, allows traffic to proceed in the A lanes and the A-prime lanes.

Figures 7, 7A, 7B, 7C, 7D:
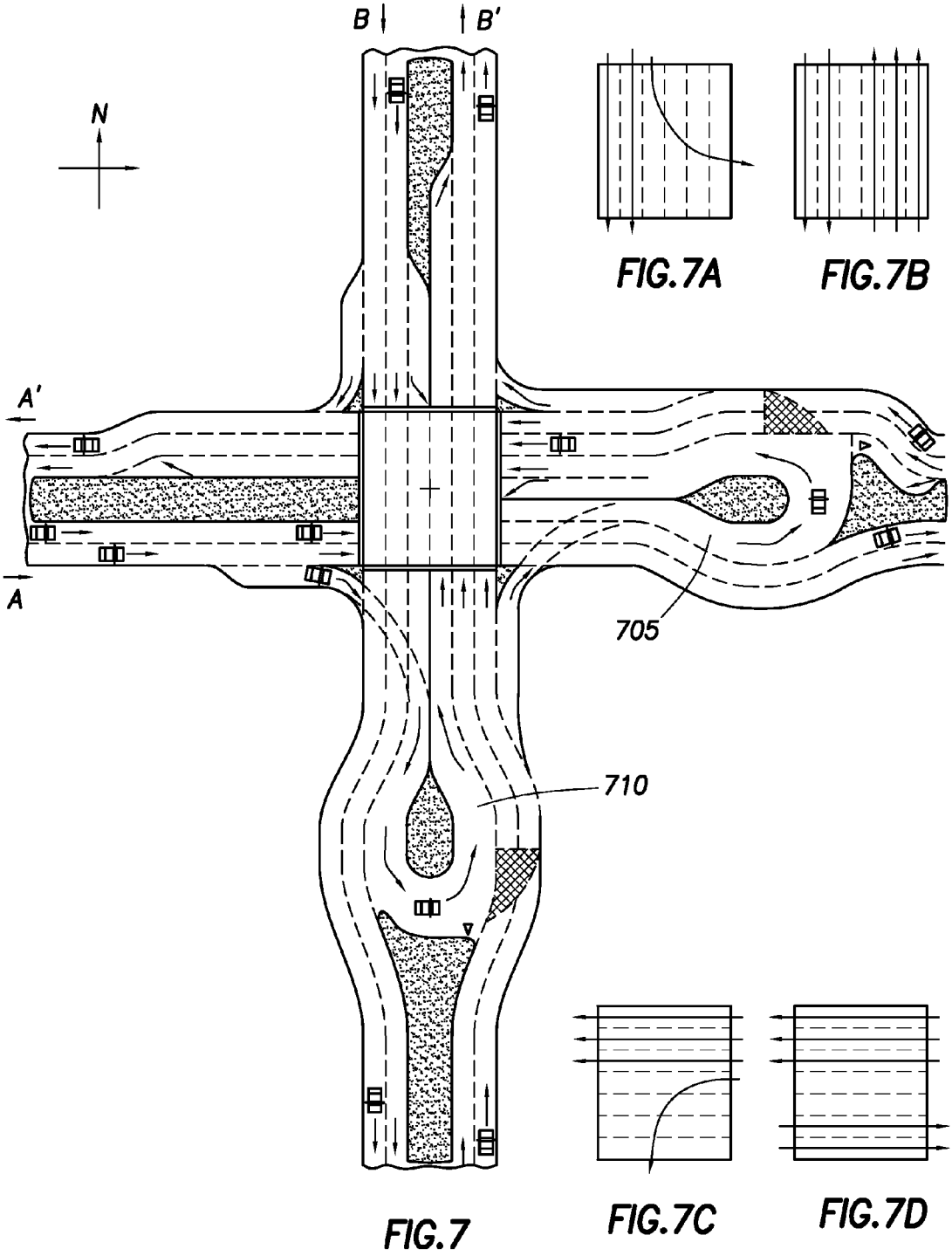
FIG. 7 is a top view of one embodiment of an intersection.
FIGS. 7A-7D illustrate the phases associated with the intersection embodiment shown in FIG. 7.

FIG. 7 illustrates another possible intersection configuration, in which two adjacent arms of the intersection have protected turn-around lanes but the other two do not. In the example shown in FIG. 7, protected turn-around lanes are provided for turns from the A lanes to the B-prime lanes and from the B-prime lanes to the A-prime lanes but not from the A-prime lanes to the B lanes or from the B lanes to the A lanes.

The intersection shown in FIG. 7 has four phases. The first, shown in FIG. 7A, allows traffic to proceed in the B direction and for turns from the B lanes to the A lanes. The second phase, shown in FIG. 7B allows traffic to proceed in the B direction and in the B-prime direction. The second phase also allows protected left turns from the A lanes to the B-prime lanes using the protected turn-around lane 710 in the south arm of the intersection. The third phase, shown in FIG. 7C, allows traffic to proceed in the A-prime direction and to turn from the A-prime lanes to the B lanes. The fourth phase, shown in FIG. 7D, allows traffic to proceed in the A direction and the A-prime direction. The third and fourth phases also allow protected left turns from the B-prime lanes to the A-prime lanes using the protected turn-around lane 705 in the east arm of the intersection.

Figures 8, 8A, 8B, 8C, 8D:
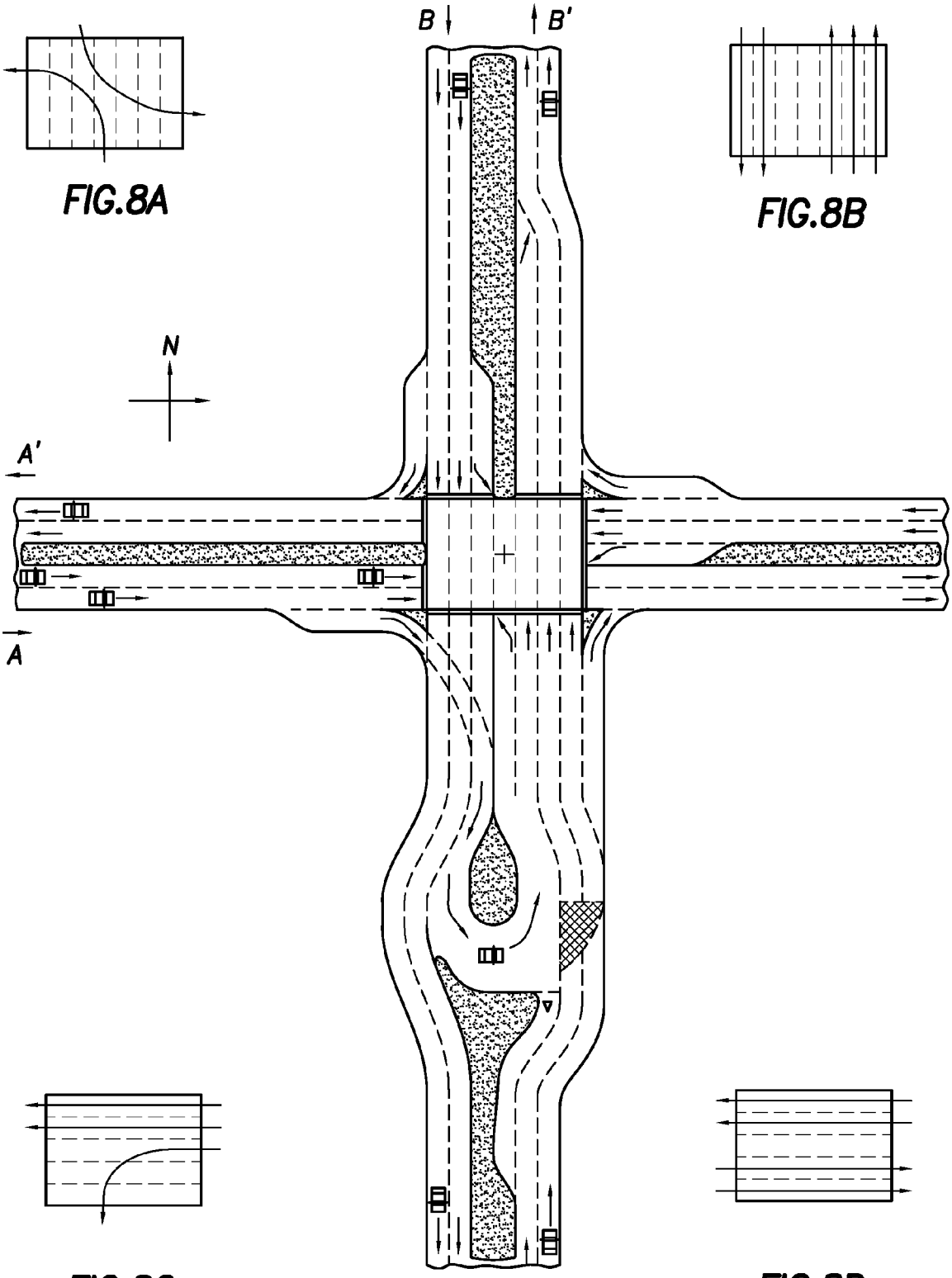
FIG. 8 is a top view of one embodiment of an intersection.
FIGS. 8A-8D illustrate the phases associated with the intersection embodiment shown in FIG. 8.

FIG. 8 illustrates another possible intersection configuration, in which one arm of the intersection has a protected turn-around lane but the other three do not. In the example shown in FIG. 8, protected turn-around lanes are provided for turns from the A lanes to the B-prime lanes but not from the B-prime lanes to the A-prime lanes, from the A-prime lanes to the B lanes, or from the B lanes to the A lanes.

The intersection shown in FIG. 8 has four phases. The first, shown in FIG. 8A, allows turns from the B lanes to the A lanes and from the B-prime lanes to the A-prime lanes. The second phase, shown in FIG. 8B allows traffic to proceed in the B direction and in the B-prime direction. The second phase also allows protected left turns from the A lanes to the B-prime lanes using the protected turn-around lane. The third phase, shown in FIG. 8C, allows traffic to proceed in the A-prime direction and to turn from the A-prime lanes to the B lanes. The fourth phase, shown in FIG. 8D, allows traffic to proceed in the A direction and the A-prime direction.

Figure 9:
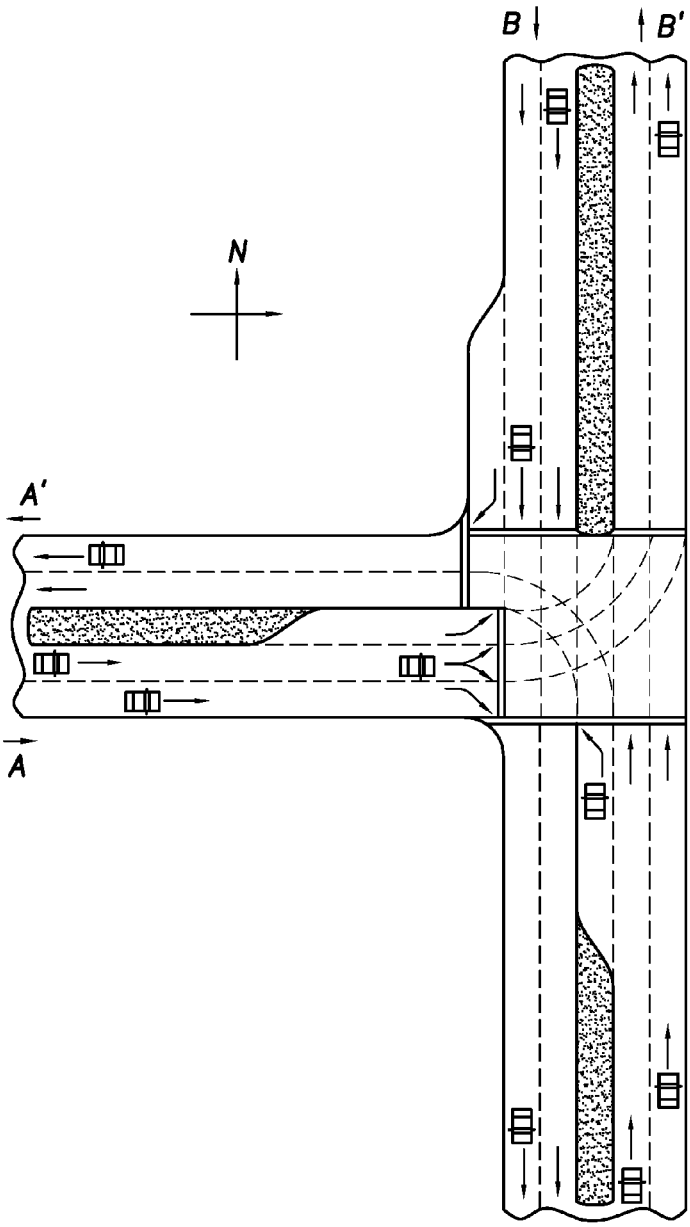
FIG.9 (PRIOR ART)
FIG. 9 is a top view of a prior art intersection.
Figure 9A:
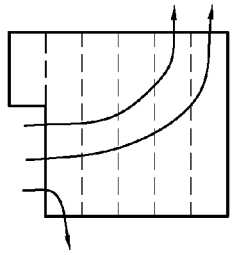
FIG.9A (PRIOR ART)
FIGS. 9A-9C illustrate the phases associated with the prior art intersection shown in FIG. 9.
Figure 9B:
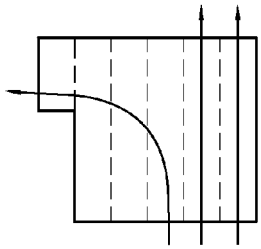
FIG.9B (PRIOR ART)
Figure 9C:
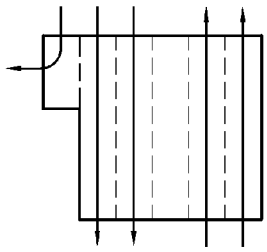
FIG.9C (PRIOR ART)

FIG. 9 illustrates a prior art "T" intersection, in which the east-west road dead ends into the intersection but the north-south road extends beyond the intersection. The intersection in FIG. 9 has three phases. In the first phase, shown in FIG. 9A, traffic is allowed to turn from the A lanes to the B lanes and the B-prime lanes. In the second phase, shown in FIG. 9B, traffic is allowed to proceed in the B-prime direction and to turn from the B-prime lanes to the A-prime lanes. In the third phase, shown in FIG. 9C, traffic is allowed to proceed in the B direction and the B-prime direction and turns are allowed from the B lanes to the A-prime lanes.

Figure 10:
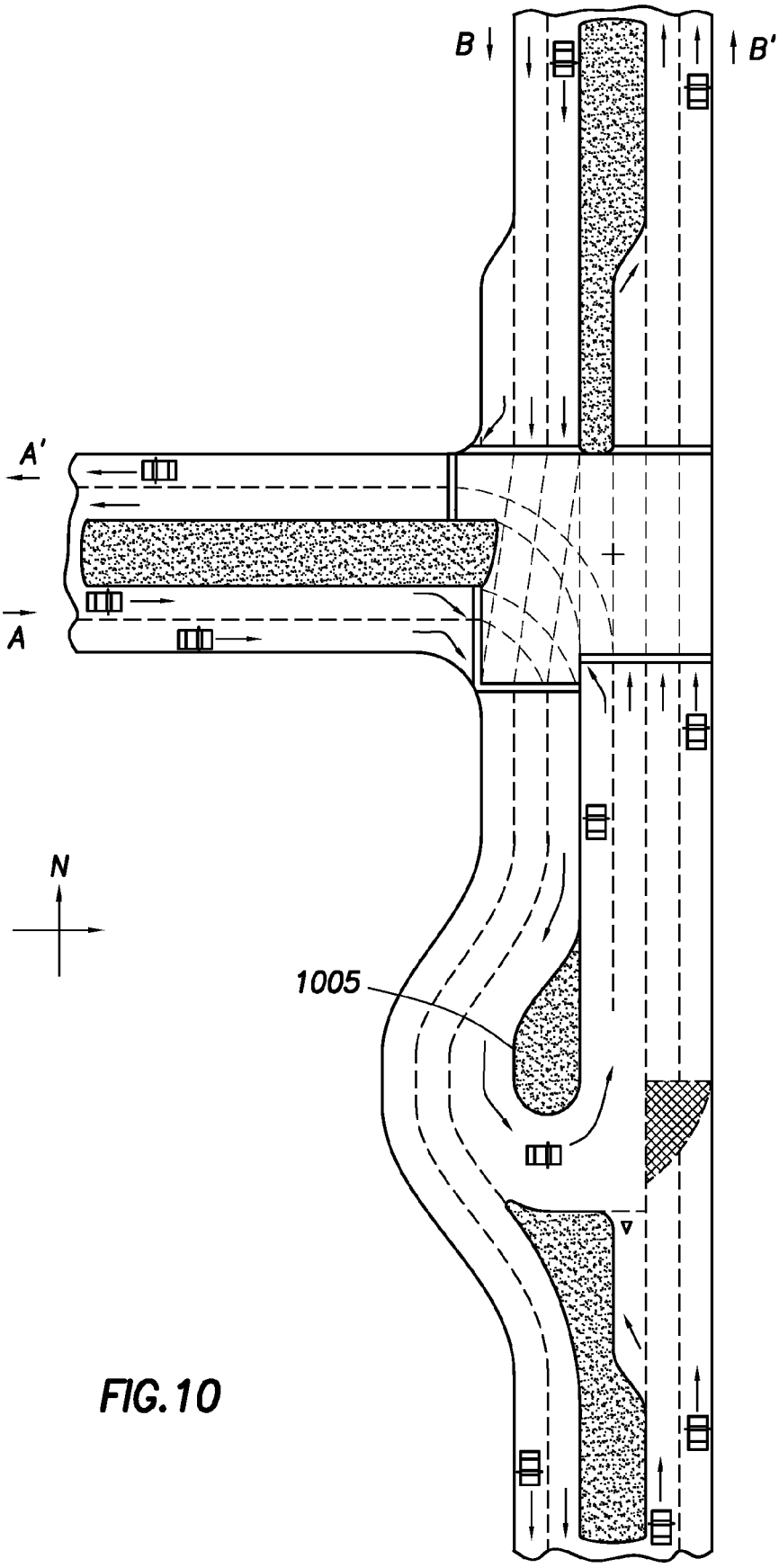
FIG. 10 is a top view of one embodiment of an intersection.
Figure 10A:
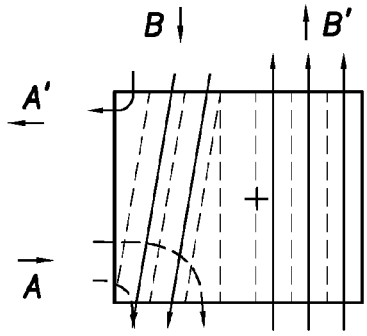
FIGS. 10A-10B illustrate the phases associated with the intersection embodiment shown in FIG. 5.
Figure 10B:
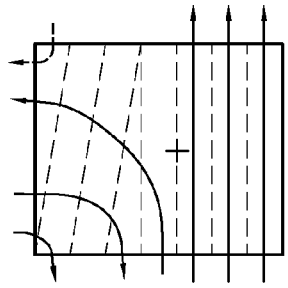

A "T" intersection incorporating a protected turn-around lane is illustrated in FIG. 10. In FIG. 10, a protected turn-around lane is provided for turns from the A lanes to the B-prime lanes. The resulting intersection has two phases. The first phase, illustrated in FIG. 10A, allows traffic to proceed in the B direction and the B-prime direction and a right turn from the B lanes to the A-prime lanes. The first phase also allows a yielded right turn from the A lanes to the B lanes. The second phase, illustrated in FIG. 10B, allows traffic to proceed in the B-prime direction and for turns from the B-prime lanes to the A-prime lanes and from the A lanes to the B lanes. The second phase also allows a yielded right turn from the B lanes to the A-prime lanes.

Figure 10C:
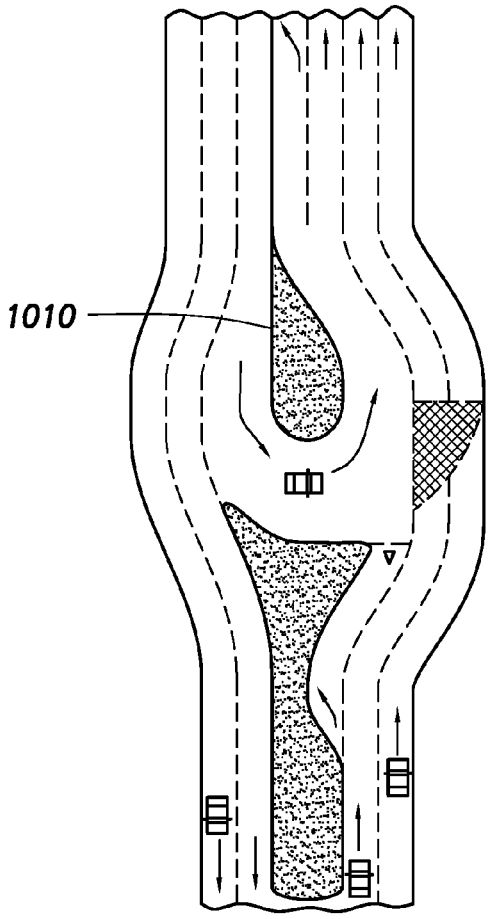
FIGS. 10C-10D illustrate variations on the intersection embodiment shown in FIG. 10.
Figure 10D:
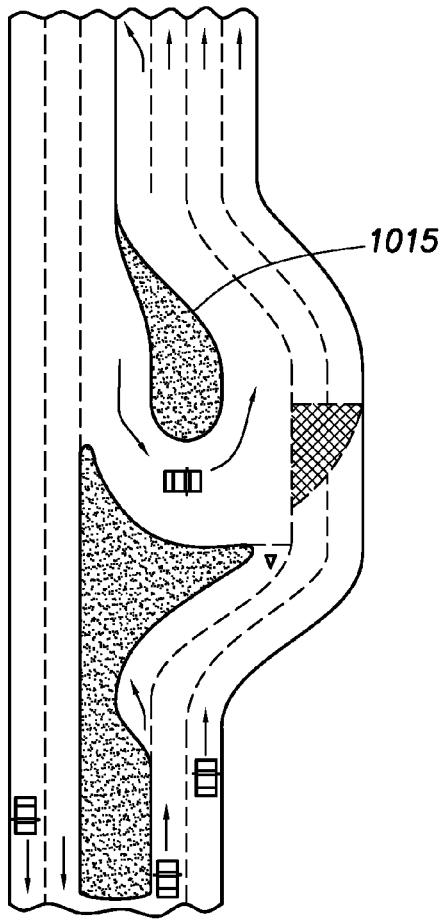

In FIG. 10, the concrete structure 1005 that forms the protected turn-around lane bulges to the west. FIGS. 10C and 10D illustrate two different configurations of the concrete structure. In FIG. 10C, the concrete structure 1010 bulges to the west. In FIG. 10D, the concrete structure 1015 deviates to the east and then bulges to the east. The latter configuration accommodates situations in which it is not possible or desirable to have the B lanes deviate to the west around the protected turn-around lane.

Figure 11:
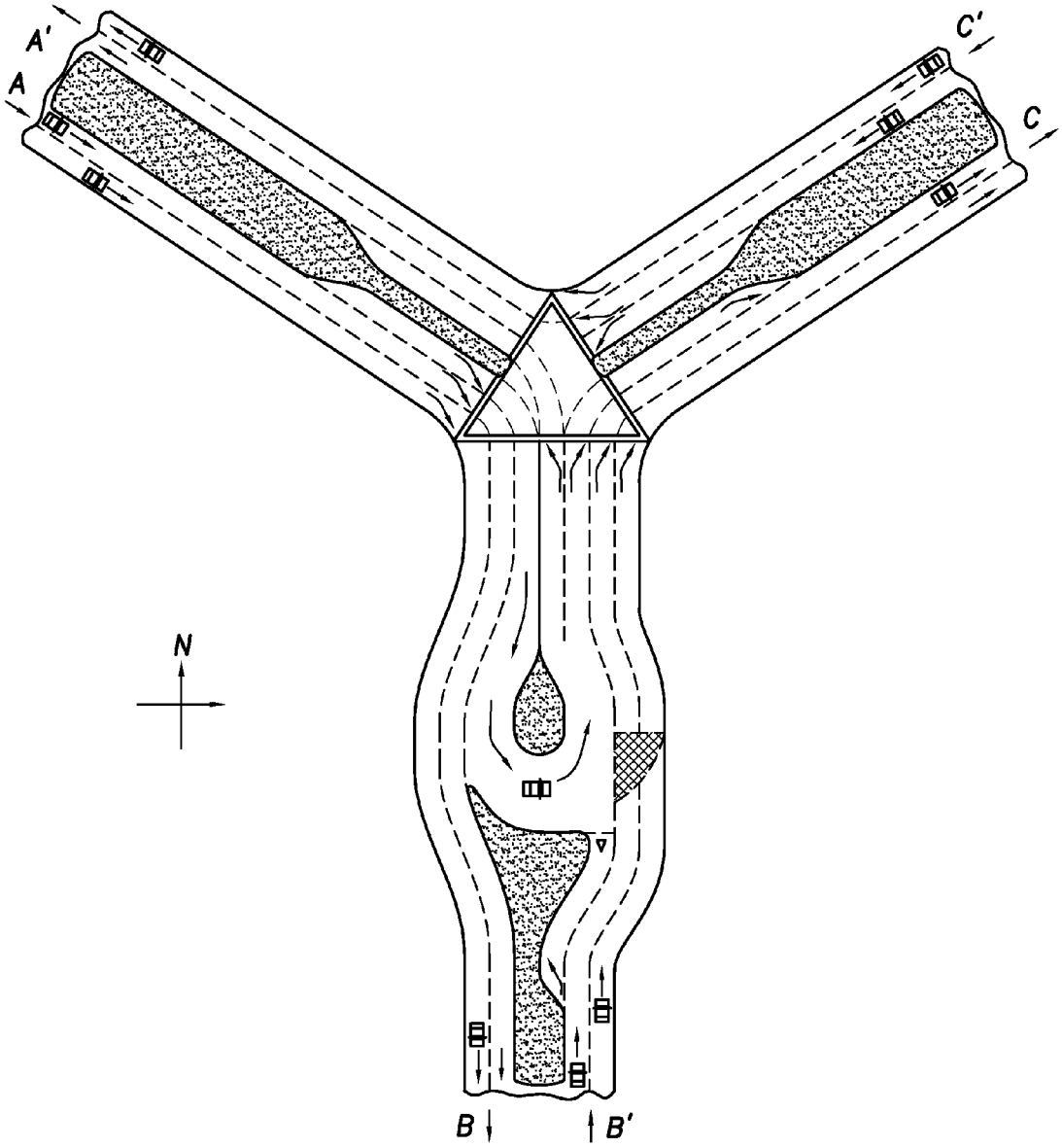
FIG. 11 is a top view of one embodiment of an intersection.
Figure 11A:
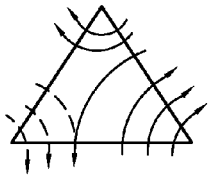
FIGS. 11A-11B illustrate the phases associated with the intersection embodiment shown in FIG. 5.
Figure 11B:
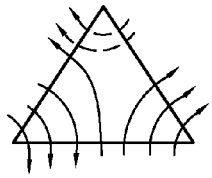

A "Y" intersection can also benefit from protected turn-around lanes, as shown in FIG. 11. In FIG. 11, a protected turn-around lane is provided for turns from the A direction to the C direction. The "Y" intersection in FIG. 11 has two phases. The first phase, shown in FIG. 1A, allows traffic to turn from the B-prime lanes to the C lanes, from the C-prime lanes to the A-prime lanes and from the C-prime lanes to the B lanes. The first phase also allows a yielded right turn from the A lanes to the B lanes. The second phase, shown in FIG. 1B, allows traffic to turn from the B-prime lanes to the C lanes, from the B-prime lanes to the A-prime lanes and from the A lanes to the B lanes. The second phase also allows a yielded right turn from the C-prime lanes to the A-prime lanes.

Figure 12:
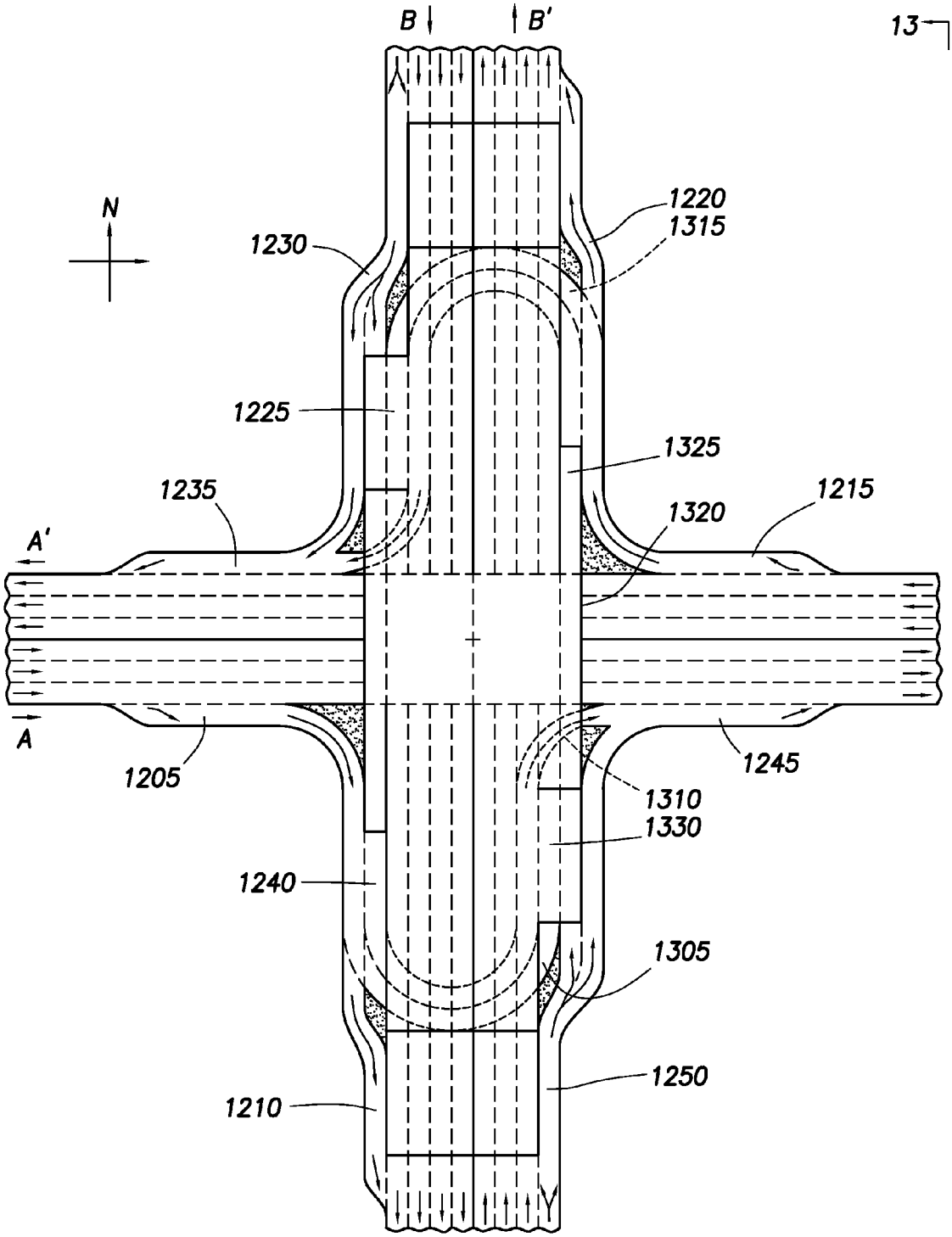
FIG. 12 is a top view of one embodiment of an intersection.

Another type of intersection, illustrated in FIG. 12, provides unrestricted traffic flow in all directions and protects all left turns. The intersection employs an overpass. An overpass is as understood in the art. It is limited to the portion of a first road passing over a second road that is in close proximity to the place where the crossing occurs. It does not include an extended elevated road. So, for example, an extended portion of road that is elevated over more than one road is not a single overpass but multiple overpasses. An overpass includes only that portion of the road that passes over the road below, the structure necessary to support it, and the adjacent structure. A cloverleaf intersection is not an overpass, for example, because, while it incorporates one road passing over another road, it also includes elements that are apart from the portion of one road that passes over another.

Figure 13:
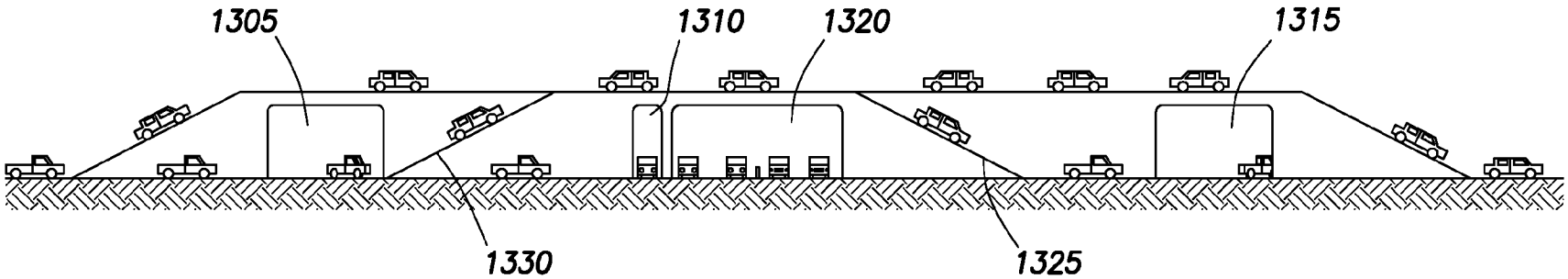
FIG. 13 is a side view of the intersection embodiment shown in FIG. 12.

The intersection in FIG. 12, illustrated in plan view in FIG. 13, includes paths 1305, 1310, and 1315 (and another path that cannot be seen in the view shown in FIG. 13) that go through the structure of the intersection. A down ramp 1325 provides access from the lanes moving from the left to the right on the overpass of FIG. 13 to path 1315. An up ramp 1330 provides access from the path 1305 to the lanes moving from the left to the right on the overpass of FIG. 13. Similar ramps, which cannot be seen in the view of FIG. 13, provide access to and from the lanes moving from the right to the left on the overpass of FIG. 13. For sake of illustration, the ramps are shown with exaggerated steepness. The actual ramps would have more gradual slopes. As will be seen more clearly in FIG. 12, paths 1305, 1310, and 1315 provide access between the lanes moving in and out of the page and those moving left and right in the page.

Reference is now made to FIG. 12, which is a top view of the intersection illustrated in FIG. 13 (FIG. 13 shows view 13 of the intersection illustrated in FIG. 12). The A lanes have an unobstructed path 1320 under the B lanes and the B-prime lanes. In addition, protected left and right turns can be made from the A lanes to the B lanes and the B-prime lanes, respectively. Exit lane 1205 from the A lanes connects to entrance lane 1210 to the B lanes, providing a path to turn right from the A lanes to the B lanes. Exit lane 1205 also connects to the path 1305. Path 1305 connects to the on ramp 1330, which provides a path to the B-prime lanes. The exit lane 1205, path 1305, and on ramp 1330 provide a protected left turn from the A lanes to the B-prime lanes.

A similar arrangement is provided for the A-prime lanes. The A-prime lanes have an unobstructed path 1320 under the B lanes and the B-prime lanes. Exit lane 1215 from the A-prime lanes connects to entrance lane 1220 to the B-prime lanes, providing a path to turn right from the A-prime lanes to the B-prime lanes. Exit lane 1215 also connects to the path 1315. Path 1315 connects to the on ramp 1225, which provides a path to the B lanes. The exit lane 1215, path 1315, and on ramp 1225 provide a protected left turn from the A-prime lanes to the B lanes.

A different arrangement is provided for the B lanes. Exit lane 1230 from the B lanes, which is at the same level as the A lanes and the A-prime lanes, connects to entrance lane 1235 to the A-prime lanes, providing a path to turn right from the B lanes to the A-prime lanes. A branch of exit lane 1230 also ascends up ramp 1225, crosses the A-prime lanes and the A lanes, descends down ramp 1240, and connects to path 1310. Path 1310 connects to the on ramp 1245, which provides a path to the A lanes. The exit lane 1230, path 1310, and on ramp 1245 provide a protected left turn from the B lanes to the A lanes.

The arrangement for the B-prime lanes is similar to that for the B lanes. Exit lane 1250 from the B-prime lanes, which is at the same level as the A lanes and the A-prime lanes, connects to entrance lane 1245 to the A lanes, providing a path to turn right from the B-prime lanes to the A lanes. A branch of exit lane 1250 also ascends up ramp 1330, crosses the A-prime lanes and the A lanes, descends down ramp 1325, and connects to path 1315. Path 1315 connects to the on ramp 1235, which provides a path to the A-prime lanes. The exit lane 1250, path 1315, and on ramp 1235 provide a protected left turn from the B-prime lanes to the A-prime lanes.

Figure 16:
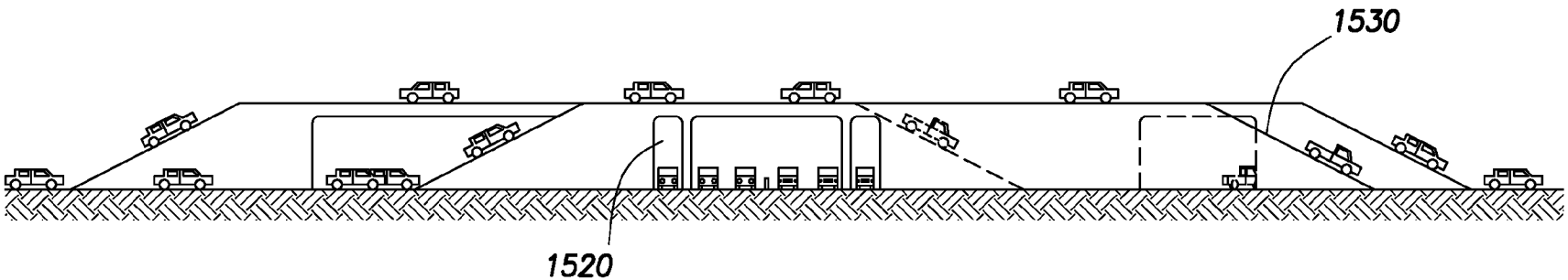
FIG. 16 is a side view of the intersection embodiment shown in FIG. 14.
Figure 14:
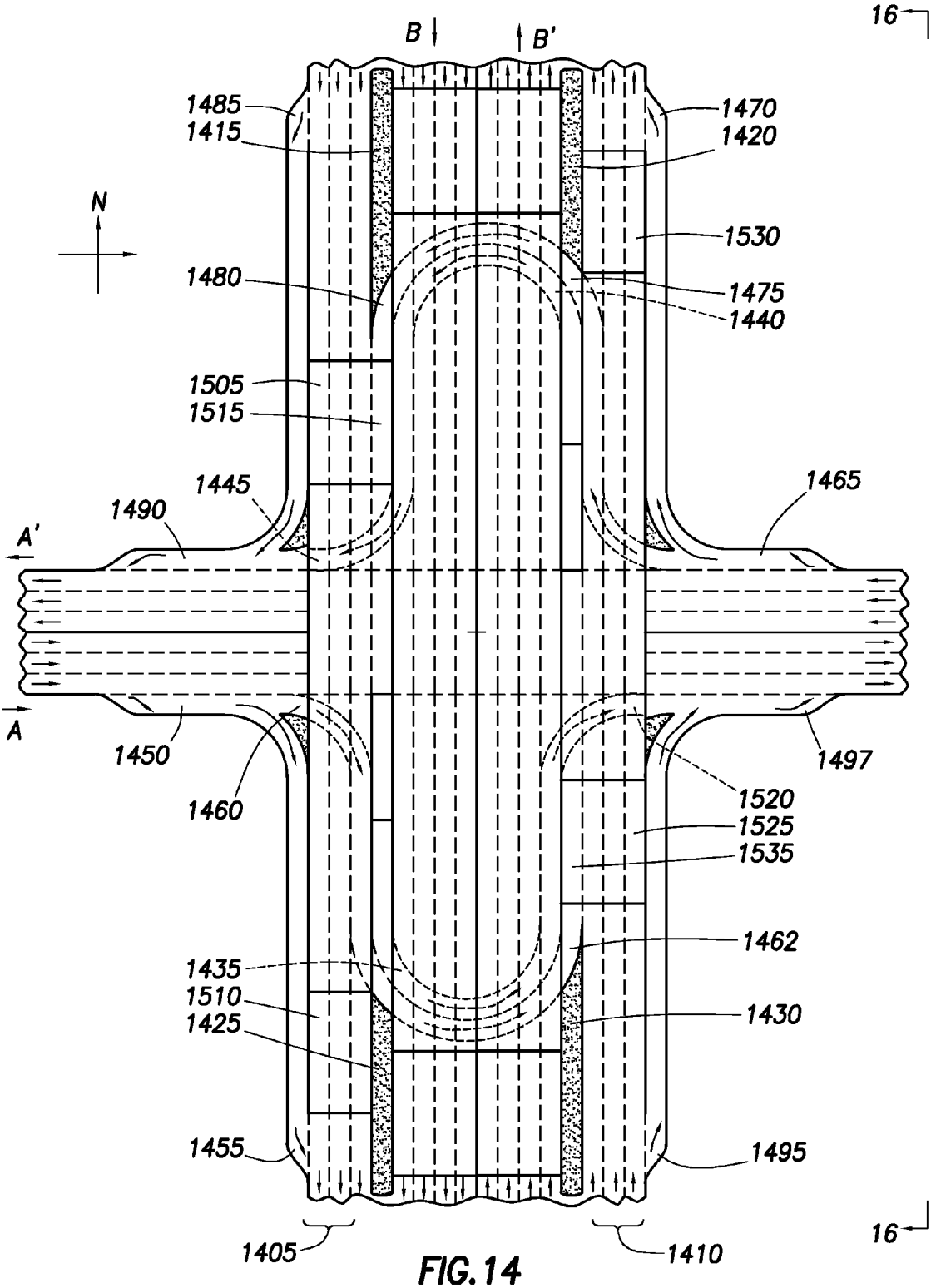
FIG. 14 is a top view of one embodiment of an intersection.
Figure 15:
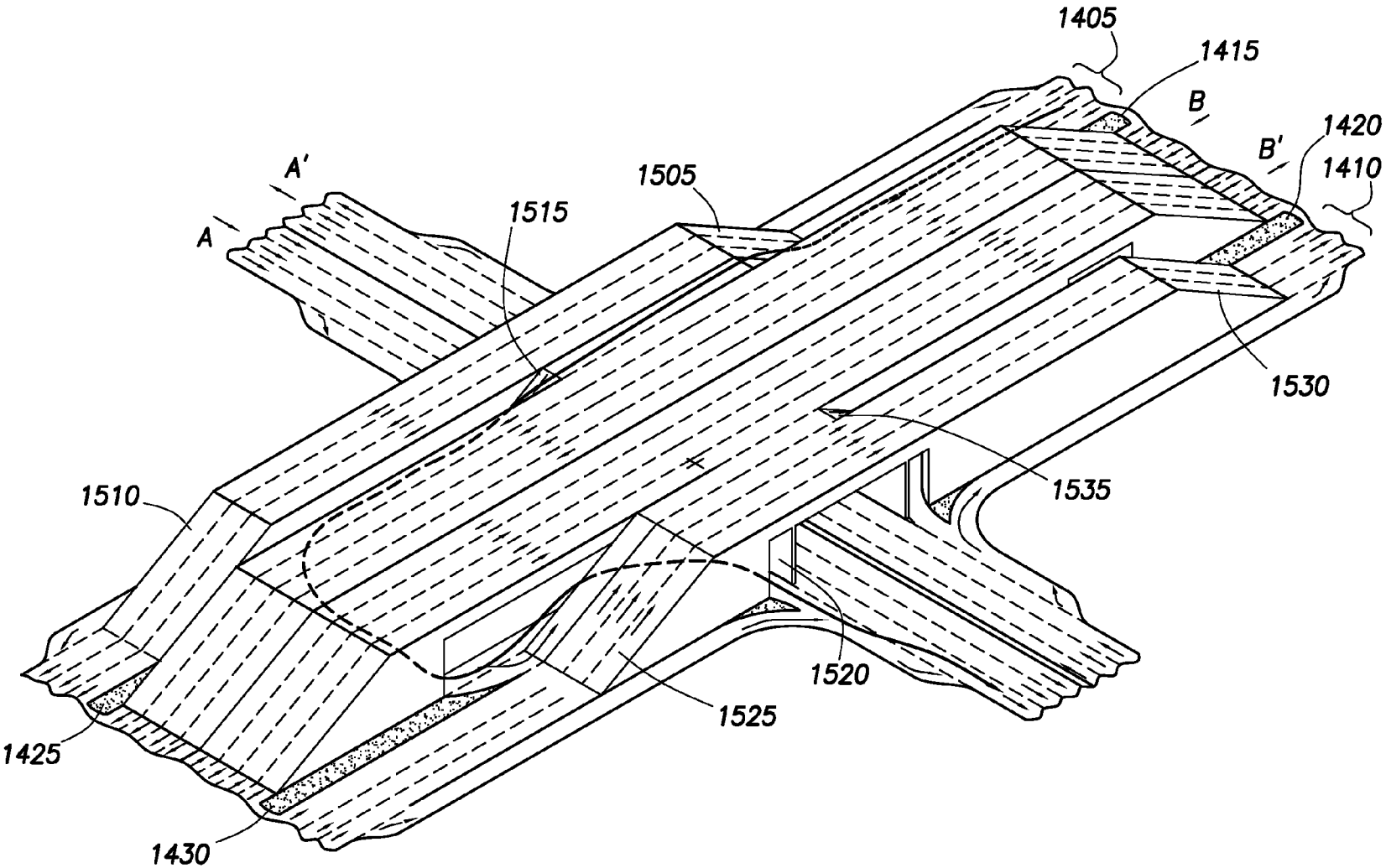
FIG. 15 is a perspective view of the intersection embodiment shown in FIG. 14.
Figure 16A:
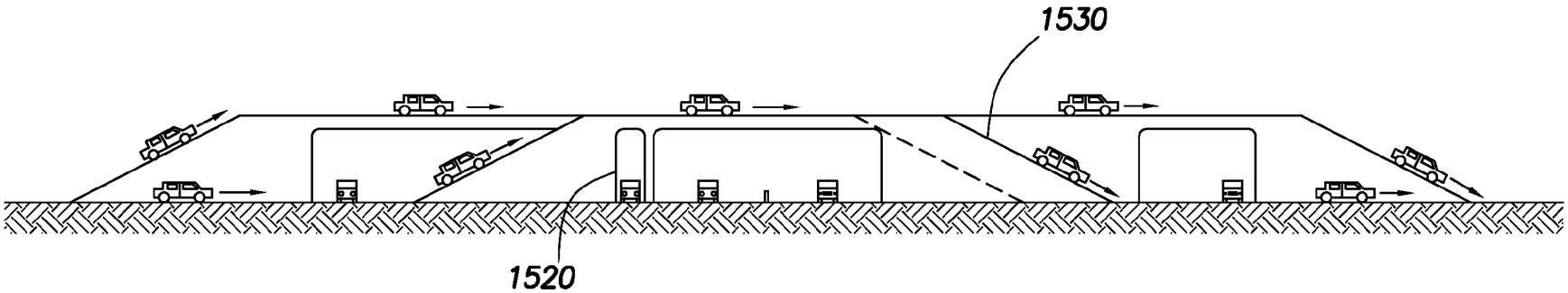
FIG. 16*a* is a side view of a modified version of the intersection embodiment shown in FIG. 14.

Another embodiment of the intersection, illustrated in FIGS. 14, 15, and 16, provides for "access lanes" adjacent to the B and B-prime lanes shown in previous embodiments. Access lanes 1405 are adjacent to and run in the same direction as the B lanes. Access lanes 1410 are adjacent to and run in the same direction as the B-prime lanes. While FIG. 14 shows 3 access lanes in the B direction and 3 access lanes in the B-prime direction, a person of ordinary skill would understand that the number of access lanes is not limiting. Medians 1415, 1420, 1425, and 1430 separate the B lanes from access lanes 1405 and the B-prime lanes from access lanes 1430. As with the previous embodiment, the B lanes and the B-prime lanes cross the A lanes and the A-prime lanes on an overpass.

The same features are illustrated in FIG. 15, which provides a perspective view of the intersection shown in FIG. 14. Access lanes 1405 ascend an up ramp 1505, cross the A lanes and A-prime lanes, and descend a down ramp 1510. A transition lane 1515, adjacent to the B lanes and access lanes 1405, and accessible to both, descends a down ramp (as shown in FIG. 15), and travels through path 1435 (see FIG. 14) to exit 1520 (see FIGS. 14, 15, 16, and 16*a*, which shows a plan view of the intersection of FIG. 14).

The access lanes 1410 traveling in the B-prime direction ascend an up ramp 1525, cross the A lanes and A-prime lanes, and descend a down ramp 1530. The overpass distance to the down ramp 1530 is shorter in FIG. 16*a*. A transition lane 1535, adjacent to the B-prime lanes and access lanes 1410, and accessible to both, descends a down ramp (as shown in FIG. 15), and travels through path 1440 (see FIG. 14) to exit 1445 (see FIG. 14).

The intersection shown in FIGS. 14, 15, and 16 allows protected right and left turns from the A, A-prime, B, and B-prime lanes. An exit lane from the A lanes 1450 connects to an entrance lane 1455 to the access lanes 1405, which allow access to the B lanes, providing a right turn from the A lanes to the B lanes. A branch of exit lane 1450 also connects to path 1460, which travels through the overpass exiting at 1462, and ascends up ramp 1525 to allow a vehicle to merge into the B-prime lanes. Exit lanes 1450, path 1460, and ramp 1525 allow a protected left turn from the A lanes to the B-prime lanes.

An exit lane from the A-prime lanes 1465 connects to an entrance lane 1470 to the access lanes 1410, which allow access to the B-prime lanes, providing a right turn from the A-prime lanes to the B-prime lanes. A branch of exit lane 1465 also connects to path 1475, which travels through the overpass exiting at 1480, and ascends up ramp 1505 to allow a vehicle to merge into the B lanes. Exit lanes 1465, path 1475, and ramp 1505 allow a protected left turn from the A-prime lanes to the B lanes.

Figure 14A:
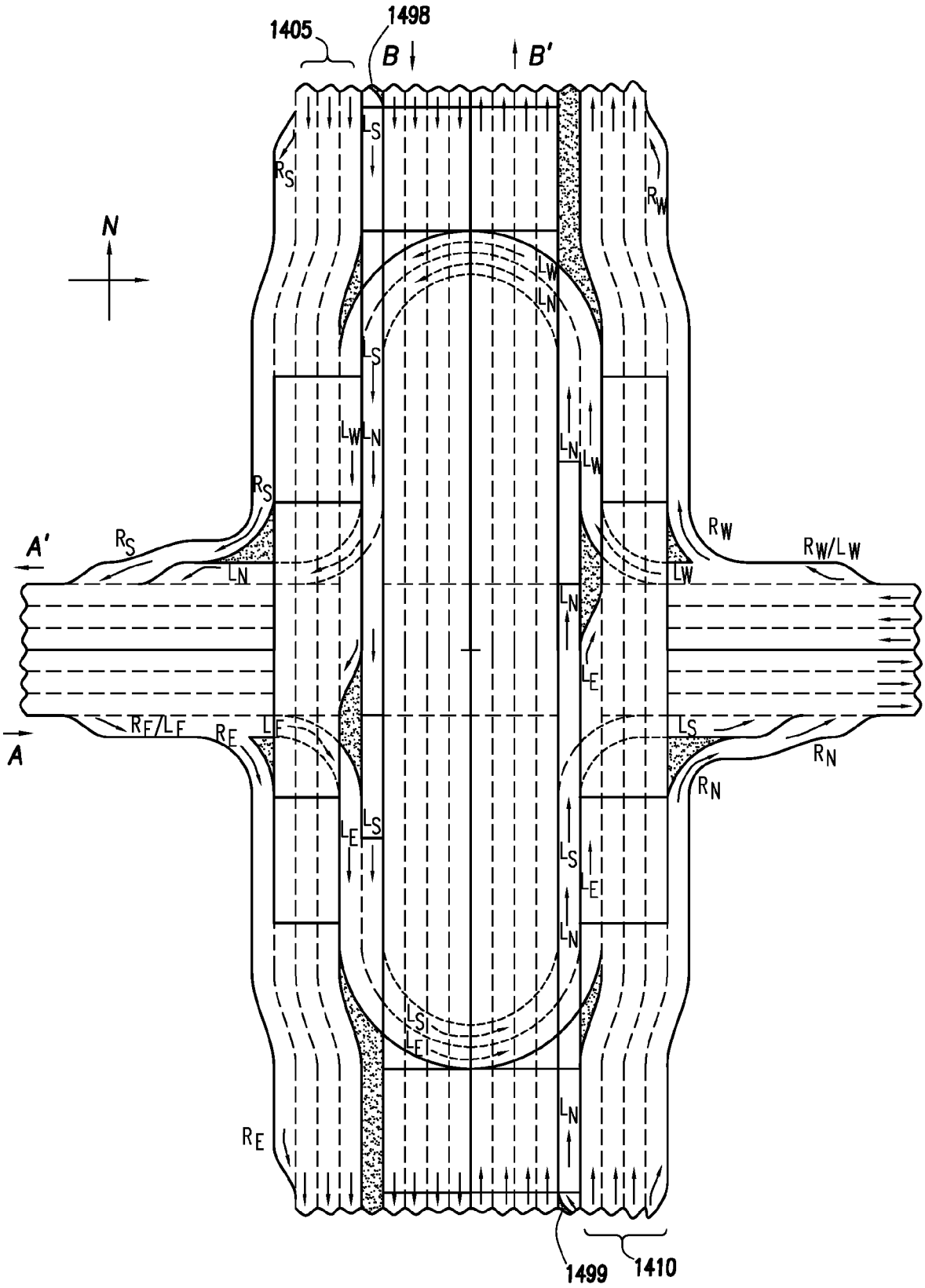
FIG. 14*a* is a top view of one embodiment of an intersection.

Turning right from the B lanes to the A-prime lanes requires exiting the B lanes to the access lanes 1405 at a point off the top of FIG. 14 and exiting the access lanes 1405 using exit lane 1485 to enter the A-prime lanes using entrance lane 1490. Turning left from the B lanes to the A lanes requires following the transitional lane 1515 through path 1435 to exit 1520 and onto the A lanes. This sequence of turns is shown graphically in FIG. 15. FIG. 14*a* illustrates a way to avoid use of the transitional lane 1515 by shortening the median strip between the access lanes 1405 and the right-most lane 1498 of the B lanes. That change allows traffic to merge from the access lanes 1405 to the B lanes in anticipation of making a left turn from the B lanes to the A lanes. FIG. 14*a* also shows symbolically the paths that would be followed in making turns from one set of lanes to another. The symbols indicate which turn they illustrate. A key for the symbols is:

| Symbol | Meaning |
|---|---|
| LN | Left turn from north-bound lanes (B-prime lanes) |
| RN | Right turn from north-bound lanes (B-prime lanes) |
| LS | Left turn from south-bound lanes (B lanes) |
| RS | Right turn from south-bound lanes (B lanes) |
| LE | Left turn from east-bound lanes (A lanes) |
| RE | Right turn from east-bound lanes (A lanes) |
| LW | Left turn from west-bound lanes (A-prime lanes) |
| RW | Right turn from west-bound lanes (A-prime lanes) |

Turning right from the B-prime lanes to the A lanes requires exiting the B-prime lanes to the access lanes 1410 at a point off the bottom of FIG. 14 and exiting the access lanes 1410 using exit lane 1495 to enter the A lanes using entrance lane 1497. Turning left from the B-prime lanes to the A-prime lanes requires following the transitional lane 1535 through path 1440 to exit 1445 and onto the A-prime lanes.

Another embodiment of the intersection with an overpass, illustrated in FIGS. 17, 18, 19, and 20, allows protected left and right turns from the A, A-prime, B, and B-prime lanes. Each arm of the intersection includes a protected turnaround lane structure 1705, 1710 (the structures in the east and west arms of the intersection are not shown because of space limitations).

A right turn from the A lanes to the B lanes is accomplished by using the exit lane 1715 from the A lanes to reach the entrance lane 1720 to the B lanes. A left turn from the A lanes to the B-prime lanes is accomplished by using the exit lane 1725 to proceed through the overpass following the path shown in FIG. 17, around the protected turnaround lane structure 1710 and onto the B-prime lanes.

A right turn from the A-prime lanes to the B-prime lanes is accomplished by using the exit lane 1730 from the A-prime lanes to reach the entrance lane 1735 to the B-prime lanes. A left turn from the A-prime lanes to the B lanes is accomplished by using the exit lane 1740 to proceed through the overpass following the path shown in FIG. 17, around the protected turnaround lane structure 1705 and onto the B lanes.

A right turn from the B lanes to the A-prime lanes is accomplished by using the exit lane 1745 from the B lanes to reach the entrance lane 1750 to the A-prime lanes. A left turn from the B lanes to the A lanes is accomplished by using the exit lane 1755 to proceed over the A-prime lanes following the path shown in FIG. 17, around a protected turnaround lane structure (not shown) and onto the A lanes.

A right turn from the B-prime lanes to the A lanes is accomplished by using the exit lane 1760 from the B-prime lanes to reach the entrance lane 1765 to the A-prime lanes. A left turn from the B-prime lanes to the A-prime lanes is accomplished by using the exit lane 1770 to proceed over the A lanes following the path shown in FIG. 17, around a protected turnaround lane structure (not shown) and onto the A-prime lanes.

Figures 17, 17A:
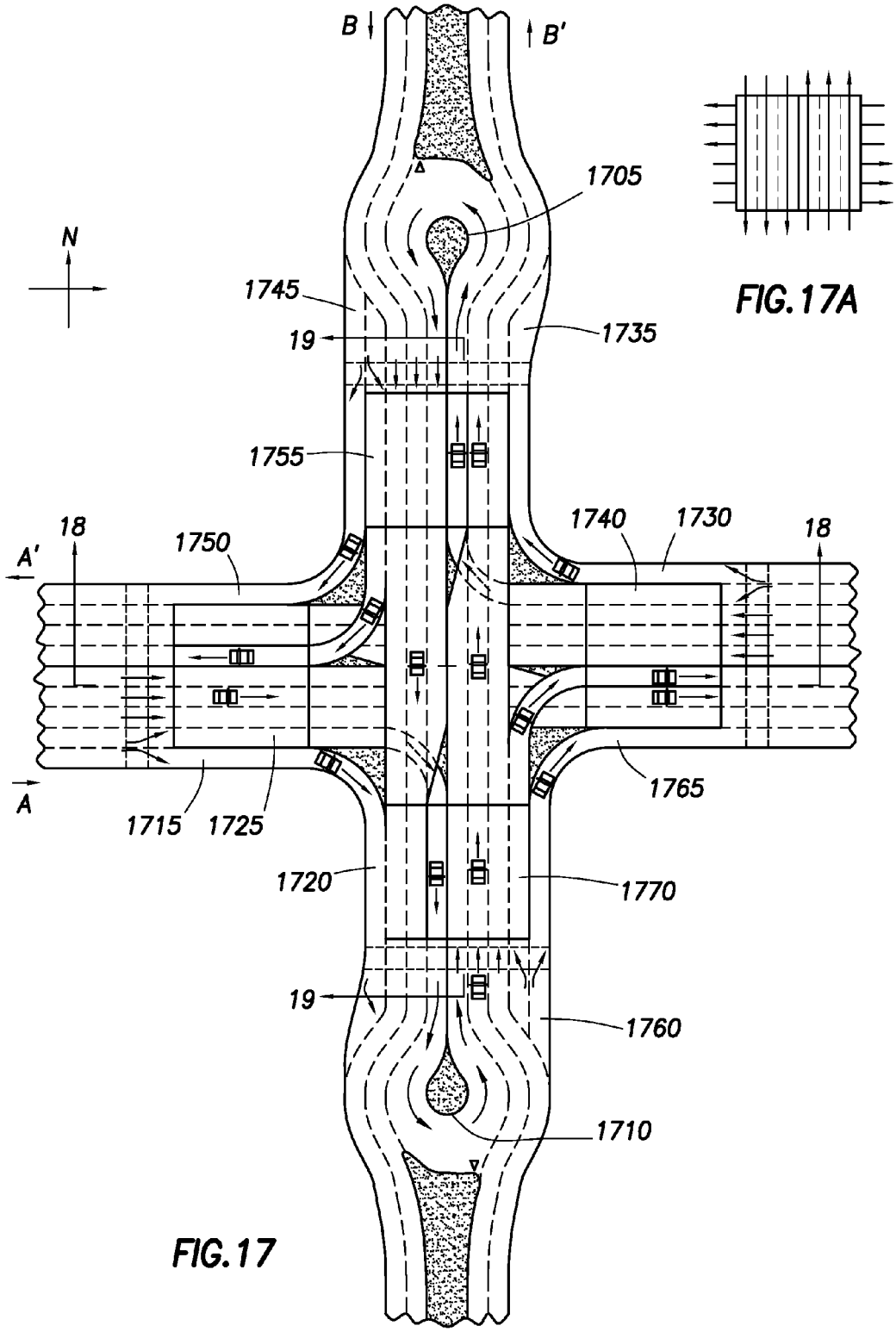
FIG. 17 is a top view of one embodiment of an intersection.
FIG. 17A illustrates the phase associated with the intersection embodiment shown in FIG. 17.
Figure 18:
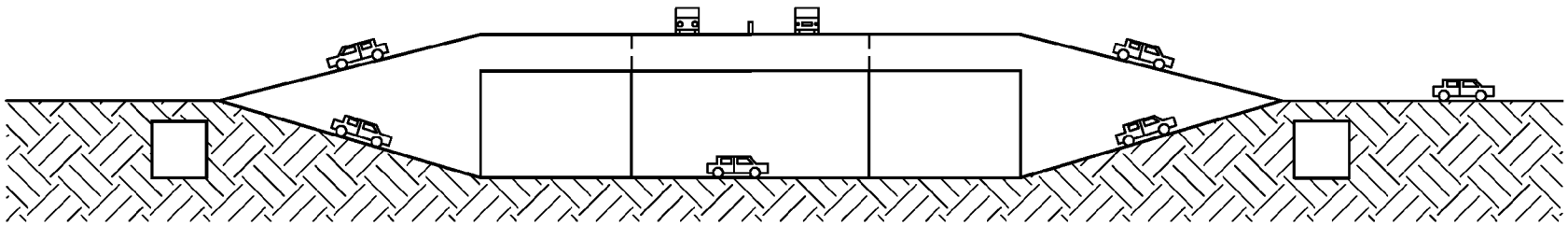
FIGS. 18 and 19 are side views of the intersection embodiment shown in FIG. 17.
Figure 19:
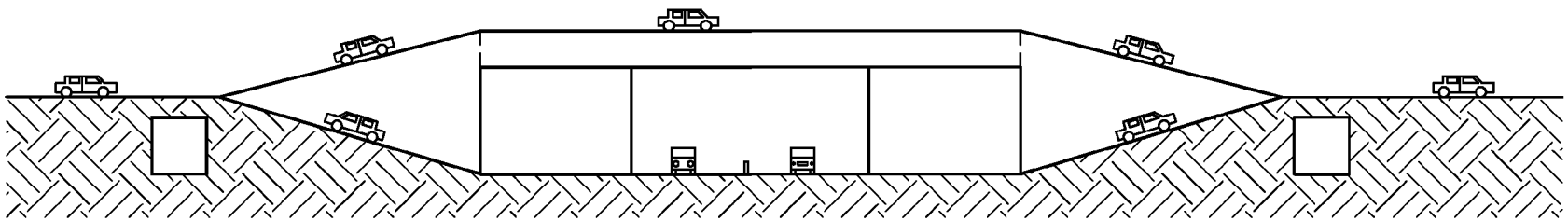
Figure 20:
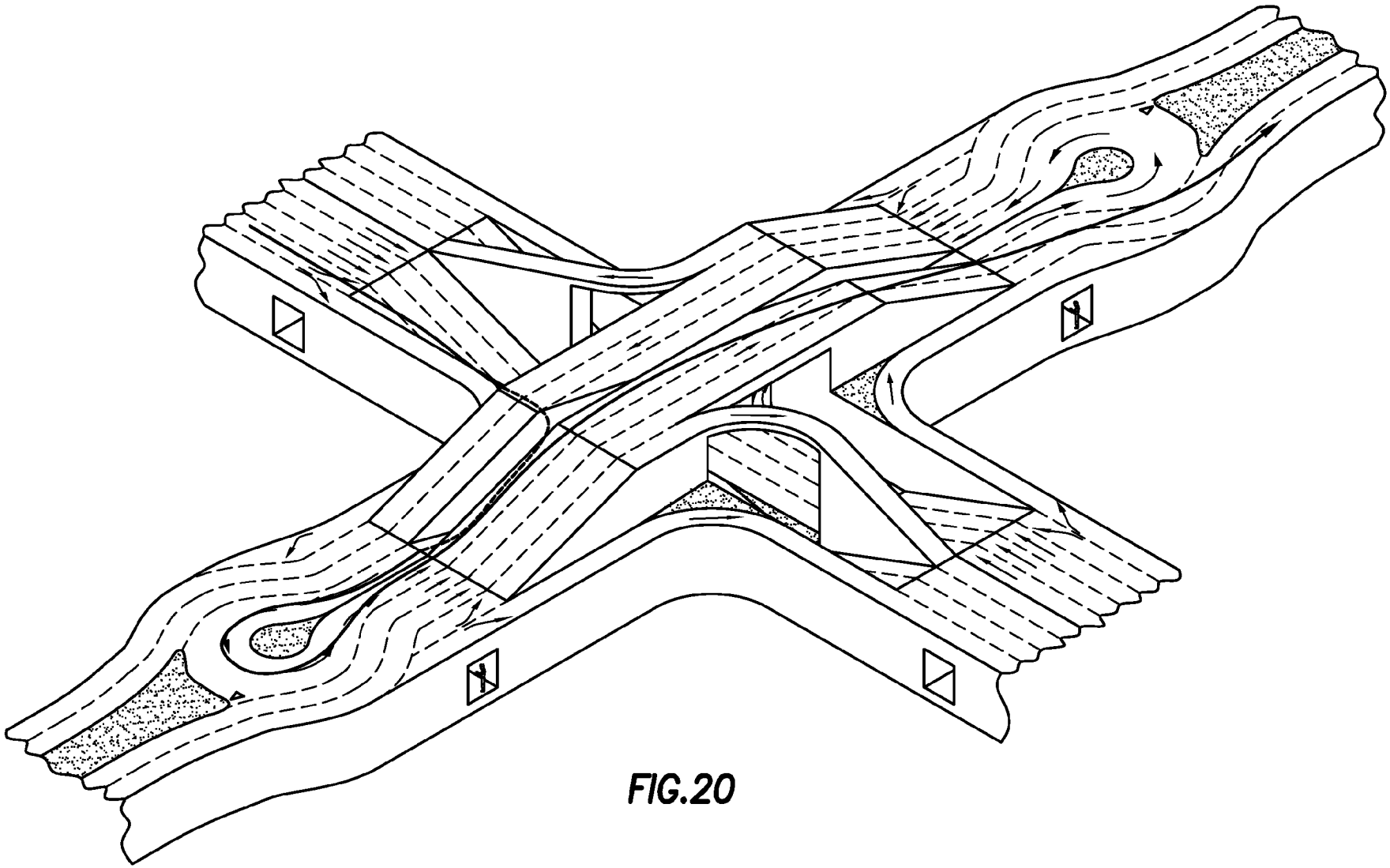
FIG. 20 is a perspective view of the intersection embodiment shown in FIG. 17.

The intersection illustrated in FIG. 17 produces a single-phase intersection, as illustrated in FIG. 17A. That is, traffic in all directions is protected. In such an intersection, no traffic light is required.

While the traffic intersection has been described in connection with the preferred embodiments of the various figures, it is to be understood that other similar embodiments may be used or modifications and additions can be made to the described embodiment for performing the same function of the traffic intersection without deviating therefrom.

The invention claimed is:

1. An article of manufacture for use in an intersection between two roads, the intersection having one or more traffic indicators to control the flow of traffic through the intersection, the one or more traffic indicators collectively having one or more traffic indicator phases, each traffic indicator phase specifying the traffic allowed to flow through the intersection during that traffic indicator phase, the intersection including:

one or more A lanes for traffic proceeding in direction A;

one or more A-prime lanes for traffic proceeding in direction A-prime, substantially opposite direction A;

one or more B lanes for traffic proceeding in direction B intersecting the A lanes and the A-prime lanes;

one or more B-prime lanes for traffic proceeding in direction B-prime, substantially opposite direction B;

a protected turn-around lane situated between the B lanes and the B-prime lanes, the protected turn-around lane being reached by turning from the A lanes to the B lanes, the protected turn-around lane allowing traffic proceeding in direction B to turn around and proceed in direction B-prime; and the protected turn-around lane providing for a protected turn from the A lanes to the B-prime lanes without having a traffic indicator phase dedicated to protecting such a turn.

2. The article of manufacture of claim 1, where:

the protected turn-around lane has a generally elliptical shape, the generally elliptical shape having one or more radii of curvature, the radii of curvature being sufficient to allow a vehicle of a predetermined size to turn through the protected turn-around lane.

3. The article of manufacture of claim 2, further including:

a do-not-block area in the B-prime lanes adjacent the protected turn-around lane, where through traffic is not to stop.

4. The article of manufacture of claim 1, further including:

a merge lane allowing traffic to merge from one of the B-prime lanes into the protected turn-around lane.

5. The article of manufacture of claim 1, further including:

using a second protected turn-around lane opposite the protected turn-around lane as an extended merge lane for merging into the B-prime lanes.

6. An article of manufacture for use in an intersection between two roads, the intersection including:

one or more A lanes for traffic proceeding in direction A;

one or more A-prime lanes for traffic proceeding in direction A-prime, substantially opposite direction A;

one or more B lanes for traffic proceeding in direction B intersecting the A lanes and the A-prime lanes;

one or more B-prime lanes for traffic proceeding in direction B-prime, substantially opposite direction B;

an overpass to allow the B lanes and the B-prime lanes to pass over the A lanes and the A-prime lanes;

an A exit lane from the A lanes, allowing traffic exiting the A lanes to travel in direction B;

a path through the overpass allowing traffic moving in direction B to turn around and travel in direction B-prime, the path being a protected path;

the A exit lane connecting to an entrance side of the path;

a B-prime entrance lane connecting to an exit side of the path; and the B-prime entrance lane allowing traffic to enter the B-prime lanes.

7. The article of manufacture of claim 6 further including:

B access lanes parallel and adjacent to the B lanes;

the A exit lane connection to the entrance side of the path being under the B access lanes.

8. The article of manufacture of claim 6 further including:

a B entrance lane connected to the A exit lane;

the B entrance lane allowing traffic to enter the B lanes.

9. The article of manufacture of claim 6 where:

the path is a tunnel.

10. The article of manufacture of claim 6 further including:

a B exit lane from the B lanes;

the B exit lane connecting to an entrance side of the path;

an A entrance lane connecting to an exit side of the path; and the A entrance lane allowing traffic to enter the A lanes.

11. The article of manufacture of claim 10 further including:

an A-prime exit lane from the A-prime lanes, allowing traffic exiting the A-prime lanes to travel in direction B-prime;

a second path through the overpass allowing traffic moving in direction B-prime to turn around and travel in direction B, the path being a protected path;

the A-prime exit lane connecting to an entrance side of the second path;

a B entrance lane connecting to an exit side of the second path;

the B entrance lane allowing traffic to enter the B lanes;

a B-prime exit lane from the B-prime lanes;

the B-prime exit lane connecting to an entrance side of the second path;

an A-prime entrance lane connecting to an exit side of the second path; and the A-prime entrance lane allowing traffic to enter the A-prime lanes.

12. The article of manufacture of claim 10 further including:

B-prime access lanes parallel and adjacent to the B-prime lanes;

the A-prime exit lane connection to the entrance side of the second path being under the B-prime access lanes.

13. The article of manufacture of claim 10 further including:

a B-prime entrance lane connected to the A-prime exit lane;

the B-prime entrance lane allowing traffic to enter the B-prime lanes.

14. An article of manufacture for use in an intersection between two roads, the intersection including:

one or more A lanes for traffic proceeding in direction A;

one or more A-prime lanes for traffic proceeding in direction A-prime, substantially opposite direction A;

one or more B lanes for traffic proceeding in direction B intersecting the A lanes and the A-prime lanes;

one or more B-prime lanes for traffic proceeding in direction B-prime, substantially opposite direction B;

an overpass to allow the B lanes and the B-prime lanes to pass over the A lanes and the A-prime lanes; and a protected turn-around lane situated between the B lanes and the B-prime lanes, the protected turn-around lane being reached by turning from the A lanes to the B lanes crossing under one or more B lanes through the underpass, the protected turn-around lane allowing traffic proceeding in direction B to turn around and proceed in direction B-prime.

15. The article of manufacture of claim 14 further including:

an A exit lane from the A lanes, allowing traffic exiting the A lanes to travel in direction B.

16. The article of manufacture of claim 14 further including:

a protected turn-around lane situated between the A lanes and the A-prime lanes, the protected turn-around lane being reached by turning from the B-prime lanes to the A lanes crossing over one or more A lanes as part of the overpass, the protected turn-around lane allowing traffic proceeding in direction A to turn around and proceed in direction A-prime.

17. The article of manufacture of claim 14 further including:

a B-prime exit lane from the B-prime lanes, allowing traffic exiting the B-prime lanes to travel in direction A.

* * * * *